US012018682B2

(12) United States Patent
Choi et al.

(10) Patent No.: US 12,018,682 B2
(45) Date of Patent: Jun. 25, 2024

(54) SCROLL COMPRESSOR AND AIR CONDITIONER HAVING SAME

(71) Applicant: LG Electronics Inc., Seoul (KR)

(72) Inventors: Yongkyu Choi, Seoul (KR); Kangwook Lee, Seoul (KR); Jaeha Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 204 days.

(21) Appl. No.: 17/707,382

(22) Filed: Mar. 29, 2022

(65) Prior Publication Data

US 2022/0316474 A1 Oct. 6, 2022

(30) Foreign Application Priority Data

Mar. 30, 2021 (KR) ..... 10-2021-0041371

(51) Int. Cl.
*F04C 18/02* (2006.01)
*F04C 23/00* (2006.01)
*F04C 29/12* (2006.01)

(52) U.S. Cl.
CPC ..... *F04C 18/0207* (2013.01); *F04C 23/005* (2013.01); *F04C 23/008* (2013.01); *F04C 29/12* (2013.01); *F04C 2240/30* (2013.01); *F04C 2240/40* (2013.01); *F04C 2240/60* (2013.01)

(58) Field of Classification Search
CPC ..... F04F 5/54; F04F 5/16; F04F 5/18; F04F 5/20; F04C 18/0207; F04C 23/005; F04C 23/008; F04C 29/12; F04C 2240/30; F04C 2240/40
See application file for complete search history.

(56) References Cited

U.S. PATENT DOCUMENTS 2,967,410 A * 1/1961 Schulze ..... F25B 31/008 62/505
3,006,164 A * 10/1961 McMillan ..... F25B 13/00 62/505
4,045,975 A * 9/1977 McCarty ..... F25B 13/00 62/505
5,087,170 A * 2/1992 Kousokabe ..... F04C 29/025 415/110
2009/0252276 A1* 10/2009 Ishida ..... G21C 15/25 417/174
2016/0047380 A1 2/2016 Kim et al.
2021/0239118 A1* 8/2021 Lee ..... F04C 18/34

FOREIGN PATENT DOCUMENTS

KR 20160020191 2/2016
KR 20180115174 10/2018

* cited by examiner

*Primary Examiner* — Bryan M Lettman
(74) *Attorney, Agent, or Firm* — Fish & Richardson P.C.

(57) ABSTRACT

A scroll compressor of an air conditioner includes a refrigerant discharge tube through which refrigerant discharged to an inner space of a casing is discharged into a refrigeration cycle. The scroll compressor further including a venturi tube disposed adjacent to the refrigerant discharge tube in the inner space of the casing, and a liquid refrigerant discharge tube having a first end connected to the venturi tube and a second end opposite to the first end and communicating with the inner space of the casing at a lower side of the refrigerant discharge tube, where liquid refrigerant can be suppressed from excessively stagnating in the inner space of the casing.

12 Claims, 9 Drawing Sheets

SCROLL COMPRESSOR AND AIR CONDITIONER HAVING SAME

CROSS-REFERENCE TO RELATED APPLICATION

Pursuant to 35 U.S.C. § 119(a), this application claims the benefit of the earlier filing date and the right of priority to Korean Patent Application No. 10-2021-0041371, filed on Mar. 30, 2021, the contents of which are incorporated by reference herein in their entirety.

TECHNICAL FIELD

The present disclosure relates to a scroll compressor and an air conditioner having the same, and more particularly, to a high-pressure type scroll compressor and an air conditioner having the same.

BACKGROUND

In general, a compressor is a machine used for generating high pressure or transporting a high-pressure fluid, and in the case of being applied to a refrigeration cycle of a refrigerator or an air conditioner, serves to compress refrigerant gas and transfer the compressed refrigerant gas to a condenser. Scroll compressors are mainly applied to large air conditioners such as system air conditioners installed in buildings.

In a scroll compressor, a fixed scroll is fixed in an inner space of a casing, and an orbiting scroll may be engaged with the fixed scroll to perform an orbiting motion. Suction, gradual compression and discharge of refrigerant are continuously and repeatedly carried out through compression chambers continuously formed between a fixed wrap of the fixed scroll and an orbiting wrap of the orbiting wrap.

Recently, a bottom-compression type high pressure compressor is provided in which a compression unit including a fixed scroll and an orbiting scroll is disposed below a motor unit transferring driving force to turn the orbiting scroll so as to directly receive refrigerant gas, compress the gas, and discharge the compressed gas to an upper space inside a casing. This is disclosed in Korean Patent Publication No. 10-2016-0020191 (Patent Document 1).

In the case of such a bottom-compression type scroll compressor, the refrigerant discharged into the inner space of the casing moves to a refrigerant discharge tube located at an upper portion of the casing, while oil is returned to an oil storage space defined below the compression unit. At this time, there is a burden that the oil is mixed with the refrigerant to be discharged to the outside of the compressor or is pushed by the pressure of the refrigerant to thereby stagnate at an upper side of the motor unit.

In addition, in the case of the bottom-compression type, oil is mixed with refrigerant discharged from the compression unit and moves upward through the motor unit (driving motor), and at the same time, oil above the motor unit moves downward through the motor unit. Therefore, the oil that is moving downward may be mixed with the refrigerant discharged from the compression unit to be then discharged to the outside of the compressor, or may fail to move to the lower side of the motor unit due to the refrigerant of high pressure that is moving upward. Then, as an amount of oil returned to the oil storage space is rapidly reduced, an amount of oil supplied to the compression unit is decreased, causing friction loss or wear of the compression unit.

Korean Patent Publication No. 10-2017-0115174 (Patent Document 2) discloses a technique for separating a refrigerant discharge path and an oil discharge path by providing a flow path guide between a motor unit and a compression unit. In the flow path guide disclosed in Patent Document 2, an outer wall is formed in an annular shape, and a space between a compression unit and a motor unit is divided into an inner space defining a refrigerant discharge passage and an outer space defining an oil return passage.

In the bottom-compression type scroll compressor, a liquid refrigerant may stagnate inside the casing as the internal temperature of the casing does not reach an oil superheat when it is stopped at a low temperature or when it is initially started. Then, as low-viscosity oil is supplied to the compression unit and bearing surfaces, damage to the compression unit and the bearing surfaces may occur. In addition, when an internal temperature of the casing reaches an oil superheat in a state in which liquid refrigerant stagnates inside the casing, the liquid refrigerant dissolved in the oil is vaporized and discharged to the outside of the compressor. At this time, the oil may leak together with vaporized gas refrigerant, thereby causing a shortage of oil inside the casing. This may cause aggravated damage to the compression unit and the bearing surfaces.

These drawbacks may be severe in a low-temperature environment or in a large compressor applied to an air conditioning system in a building. Particularly, since the large compressor has a larger inner space, a large quantity of liquid refrigerant is introduced when the compressor is initially started but a time to reach an oil superheat as a condition of vaporizing the liquid refrigerant may be delayed. As a result, the aforementioned problems may be further aggravated, and efficiency and reliability of the air conditioning system may be deteriorated.

SUMMARY

The present disclosure describes a scroll compressor capable of suppressing a decrease in oil viscosity or a shortage of oil inside a casing, and an air conditioner having the same.

The present disclosure also describes a scroll compressor capable of suppressing liquid refrigerant from stagnating in an inner space of a casing, and an air conditioner having the same.

The present disclosure further describes a scroll compressor capable of suppressing liquid refrigerant from stagnating in an inner space of a casing by employing a device for discharging the liquid refrigerant from the inner space of the casing, and an air conditioner having the same.

The present disclosure further describes a scroll compressor capable of more rapidly discharging liquid refrigerant from the inner space of a casing while simplifying a device for discharging the liquid refrigerant, and an air conditioner having the same.

The present disclosure further describes a scroll compressor capable of enhancing efficiency and reliability of an air conditioner, to which the scroll compressor is applied, and an air conditioner having the same.

In order to achieve the aspects and other advantages of the subject matter disclosed herein, a liquid refrigerant discharge unit may be disposed to induce liquid refrigerant stagnated in a casing toward a refrigerant discharge tube. This can suppress the liquid refrigerant from excessively stagnating in a compressor during an initial operation of the compressor.

In addition, in order to achieve those aspects of the present disclosure, a venturi tube may be disposed inside or outside the casing. Accordingly, a venturi effect of a fluid discharged at a high flow rate from the inside of the casing can be used, thereby simplifying the liquid refrigerant discharge unit.

Furthermore, in order to achieve those aspects of the subject matter disclosed herein, a venturi tube or a refrigerant discharge tube may be installed at a position with a high flow rate and an end of the liquid refrigerant discharge tube may be installed at a position with a low flow rate. This can effectively discharge stagnated liquid refrigerant while enhancing a venturi effect.

Specifically, the scroll compressor according to an implementation may include a casing, a motor unit, a compression unit, a refrigerant discharge tube, a venturi tube, and a liquid refrigerant discharge tube. The casing may have a hermetic inner space. The motor unit may be disposed in the inner space of the casing to operate a rotating shaft. The compression unit may be disposed at one side of the motor unit in the inner space of the casing, and include a discharge passage through which refrigerant compressed while the compression unit is driven by the rotating shaft is discharged into the inner space of the casing. The refrigerant discharge tube may have one end communicating with the inner space of the casing and another end connected to a refrigeration cycle, such that the refrigerant discharged into the inner space of the casing flows to the refrigeration cycle. The venturi tube may be disposed adjacent to the refrigerant discharge tube in the inner space of the casing. The liquid refrigerant discharge tube may have a first end connected to the venturi tube and a second end communicating with the inner space of the casing at a lower side of the refrigerant discharge tube. This can suppress liquid refrigerant from excessively stagnating in the inner space of the casing.

In one example, an inner passage through which spaces of both sides of the motor unit in the axial direction can communicate with each other may be defined inside the motor unit. The venturi tube may be formed such that at least a part of a first large-diameter portion open toward the motor unit overlaps the inner passage. This can increase a flow rate in the venturi tube, such that the liquid refrigerant can be discharged more quickly and effectively.

In one example, the motor unit may include a stator core fixedly fitted to an inner circumferential surface of the casing, and having a plurality of teeth formed on an inner circumferential surface thereof in a circumferential direction with slits interposed therebetween, and stator coils wound around the teeth of the stator core. The venturi tube may at least partially overlap the slit at an upper side of the stator coil. With the configuration, the venturi tube can be disposed at a position with a high flow rate, so as to further increase suction force with respect to the liquid refrigerant.

In another example, the discharge passage may be open toward the motor unit so that at least a part thereof overlaps the slit in the axial direction. The venturi tube may at least partially overlap the discharge passage at an upper side of the stator coil. This can increase a flow rate in the venturi tube, such that the liquid refrigerant can be discharged more quickly and effectively.

In one example, the venturi tube may include a first large-diameter portion defining a first open end and facing the motor unit, a second large-diameter portion defining a second open end and opposing the motor unit, and a small-diameter portion communicating the first large-diameter portion and the second large-diameter portion with each other. The second large-diameter portion may be disposed eccentrically with respect to an axial center of the refrigerant discharge tube. A first spacing height from the motor unit to an end of the second large-diameter portion may be lower than or equal to a second spacing height from the motor unit to an inner end of the refrigerant discharge tube. This can reduce flow resistance with respect to the liquid refrigerant passing through the venturi tube, such that the liquid refrigerant can be discharged quickly.

In one example, the venturi tube may include a first large-diameter portion defining a first open end and facing the motor unit, a second large-diameter portion defining a second open end and opposing the motor unit, and a small-diameter portion disposed between the first large-diameter portion and the second large-diameter portion and connected with the liquid refrigerant discharge tube. The second large-diameter portion may be disposed coaxially with the refrigerant discharge tube. This can facilitate manufacturing of the venturi tube and also further increase the flow rate in the venturi tube so as to increase suction force for the liquid refrigerant.

In another example, the first large-diameter portion and the second large-diameter portion may be disposed on different axes. With the configuration, an inlet of the venturi tube can be disposed at a position with a fast flow rate and an outlet of the venturi tube can be disposed adjacent to the refrigerant discharge tube, so that the liquid refrigerant can be discharged more quickly.

In another example, the first large-diameter portion and the second large-diameter portion may be disposed coaxially with each other. The refrigerant discharge tube may be disposed eccentrically with respect to an axial center of the rotating shaft. With the configuration, the venturi tube and the refrigerant discharge tube can be disposed at a position with a high flow rate, so as to further increase the suction force with respect to the liquid refrigerant.

In one example, the discharge passage may be open toward a discharge space between the motor unit and the compression unit. The second end of the liquid refrigerant discharge tube may be located in the discharge space. This can allow liquid refrigerant stagnating in the discharge space to be quickly discharged and secure an appropriate amount of oil in the inner space of the casing.

In another example, the discharge passage may be provided by at least one along a circumferential direction. The second end of the liquid refrigerant discharge tube may be spaced apart from the discharge passage in the circumferential direction. With the configuration, the liquid refrigerant can be more effectively discharged as an inlet of the liquid refrigerant discharge tube is disposed at a portion where the liquid refrigerant stagnates the most.

A scroll compressor according to another implementation may include a casing, a motor unit, a compression unit, a refrigerant discharge tube, and a liquid refrigerant discharge tube. The casing may have a hermetic inner space. The motor unit may be disposed in the inner space of the casing to operate a rotating shaft. The compression unit may be disposed at one side of the motor unit in the inner space of the casing, and include a discharge passage through which refrigerant compressed while the compression unit is driven by the rotating shaft is discharged into the inner space of the casing. The refrigerant discharge tube may have one end communicating with the inner space of the casing and another end connected to a refrigeration cycle, such that the refrigerant discharged into the inner space of the casing flows to the refrigeration cycle. The liquid refrigerant discharge tube may have a first end connected to the refrigerant discharge tube and a second end communicating with the inner space of the casing at a lower side of the refrigerant discharge tube. This can suppress liquid refrigerant from excessively stagnating in the inner space of the casing even without using a separate venturi tube.

In one example, the first end of the liquid refrigerant discharge tube may be connected to the refrigerant discharge tube in the inner space of the casing. This can facilitate connection of the liquid refrigerant discharge tube and also simplify a piping structure for this.

In another example, the refrigerant discharge tube may penetrate through the casing in an axial direction coaxially with the rotating shaft. Accordingly, refrigerant inside an upper space can be uniformly discharged and also liquid refrigerant can be discharged quickly and effectively.

In another example, the motor unit may include a stator core fixedly fitted to an inner circumferential surface of the casing, and having a plurality of teeth formed on an inner circumferential surface thereof in a circumferential direction with slits interposed therebetween, and stator coils wound around the teeth of the stator core. The refrigerant discharge tube may at least partially overlap the slit at an upper side of the stator coil. With the configuration, the refrigerant discharge tube can be disposed at a position with a high flow rate, so as to further increase suction force with respect to the liquid refrigerant.

In one example, the first end of the liquid refrigerant discharge tube may be connected to the refrigerant discharge tube outside the inner space of the casing. This can facilitate installation of the liquid refrigerant discharge tube and increase the degree of design freedom for the upper space of the casing.

In another example, a valve for opening and closing the liquid refrigerant discharge tube may be disposed in a middle of the liquid refrigerant discharge tube. Accordingly, the liquid refrigerant discharge tube can be selectively open or closed depending on an operating state of the compressor, thereby suppressing a reverse flow of discharged refrigerant or a leakage of oil.

In one example, the discharge passage may be open toward the discharge space between the motor unit and the compression unit, and the second end of the liquid refrigerant discharge tube may be located in the discharge space. This can facilitate installation of the liquid refrigerant discharge tube and allow quick discharge of the liquid refrigerant stagnated in the inner space of the casing.

In another example, at least one discharge passage may be formed along the circumferential direction, and the second end of the liquid refrigerant discharge tube may be spaced apart from the discharge passage in the circumferential direction. With the configuration, the liquid refrigerant can be more effectively discharged as an inlet of the liquid refrigerant discharge tube is disposed at a portion where the liquid refrigerant stagnates the most.

In one example, a flow path guide may be disposed in the discharge space between the motor unit and the compression unit to divide the discharge space into an inner space and an outer space. At least one discharge through hole defining the discharge passage and communicating with the inner space may be formed through the flow path guide. The second end of the liquid refrigerant discharge tube may be spaced apart from the discharge through hole in the circumferential direction. With the configuration, the liquid refrigerant can be more effectively discharged as an inlet of the liquid refrigerant discharge tube is disposed at a portion where the liquid refrigerant stagnates the most.

Also, in order to achieve those aspects of the subject matter disclosed herein, there is provided an air conditioner that may include a compressor, a condenser, an expander, and an evaporator. Here, the compressor may be configured as the scroll compressor described above. This can suppress a large amount of liquid refrigerant from stagnating in the compressor when the compressor is initially started, thereby preventing friction loss and wear between members due to a shortage of oil in the compressor.

DETAILED DESCRIPTION

Hereinafter, a scroll compressor and an air conditioner having the same according to the present disclosure will be described in detail with reference to the accompanying drawings. In the following description, a description of some components may be omitted to clarify features of the present disclosure.

In addition, the term "upper side" used in the following description refers to a direction away from the support surface for supporting a scroll compressor according to an implementation of the present disclosure, that is, a direction toward a motor unit when viewed based on the motor unit and a compression unit. The term "lower side" refers to a direction toward the support surface, that is, a direction toward the compression unit when viewed based on the motor unit and the compression unit.

The term "axial direction" used in the following description refers to a lengthwise (longitudinal) direction of a rotating shaft. The "axial direction" may be understood as an up and down (or vertical) direction. The term "radial direction" refers to a direction that intersects the rotating shaft.

In addition, a description will be given of a bottom-compression type scroll compressor in which a motor unit and a compression unit are arranged vertically in an axial direction and the compression unit is located below the motor unit.

In addition, a description will be given of a bottom-compression high-pressure type scroll compressor in which a refrigerant suction tube defining a suction passage is directly connected to the compression unit and communicates with an inner space of a casing.

Figure 1:
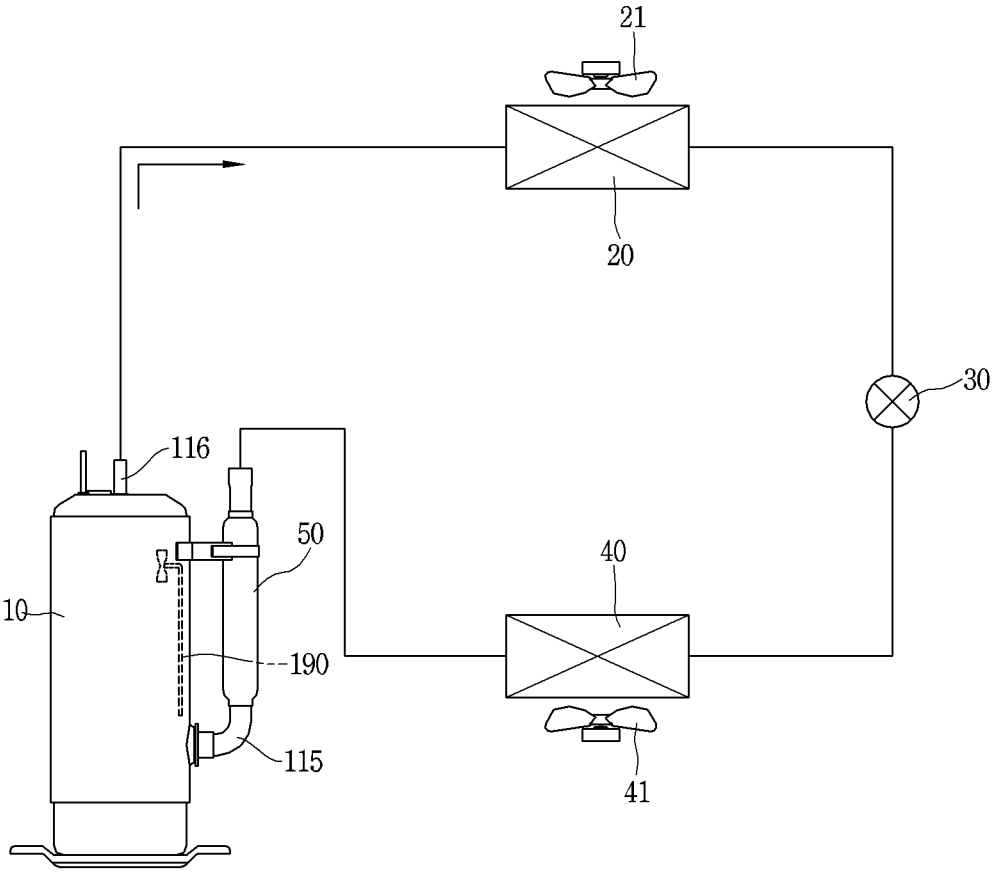
FIG. 1 is a diagram illustrating a refrigeration cycle system including a bottom-compression type scroll compressor in accordance with one implementation of the present disclosure.

FIG. 1 is a diagram illustrating a refrigeration cycle system to which a bottom-compression type scroll compressor in accordance with one implementation of the present disclosure is applied.

Referring to FIG. 1, a refrigeration cycle system to which the scroll compressor according to the implementation is applied may be configured such that a compressor 10, a condenser 20, an expander 30, and an evaporator 40 define a closed loop. The condenser 20, the expander 30, and the evaporator 40 may be sequentially connected to a discharge side of the compressor 10 and a discharge side of the evaporator 40 may be connected to a suction side of the compressor 10.

Accordingly, refrigerant compressed in the compressor 10 may be discharged toward the condenser 20, and then sucked back into the compressor 10 sequentially through the expander 30 and the evaporator 40. The series of processes may be repeatedly carried out.

Figure 2:
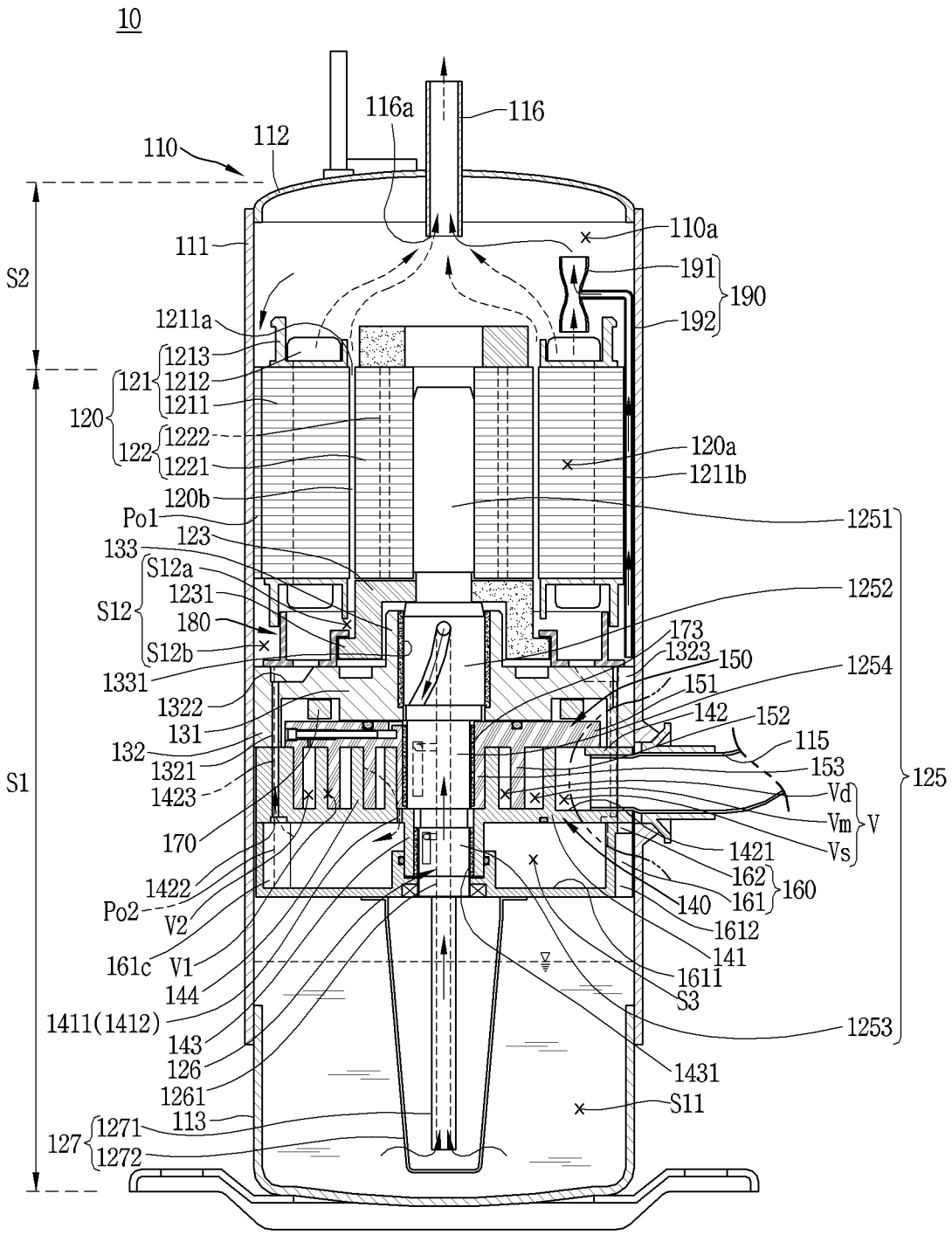
FIG. 2 is a longitudinal sectional view of a bottom-compression type scroll compressor in accordance with an implementation.
Figure 3:
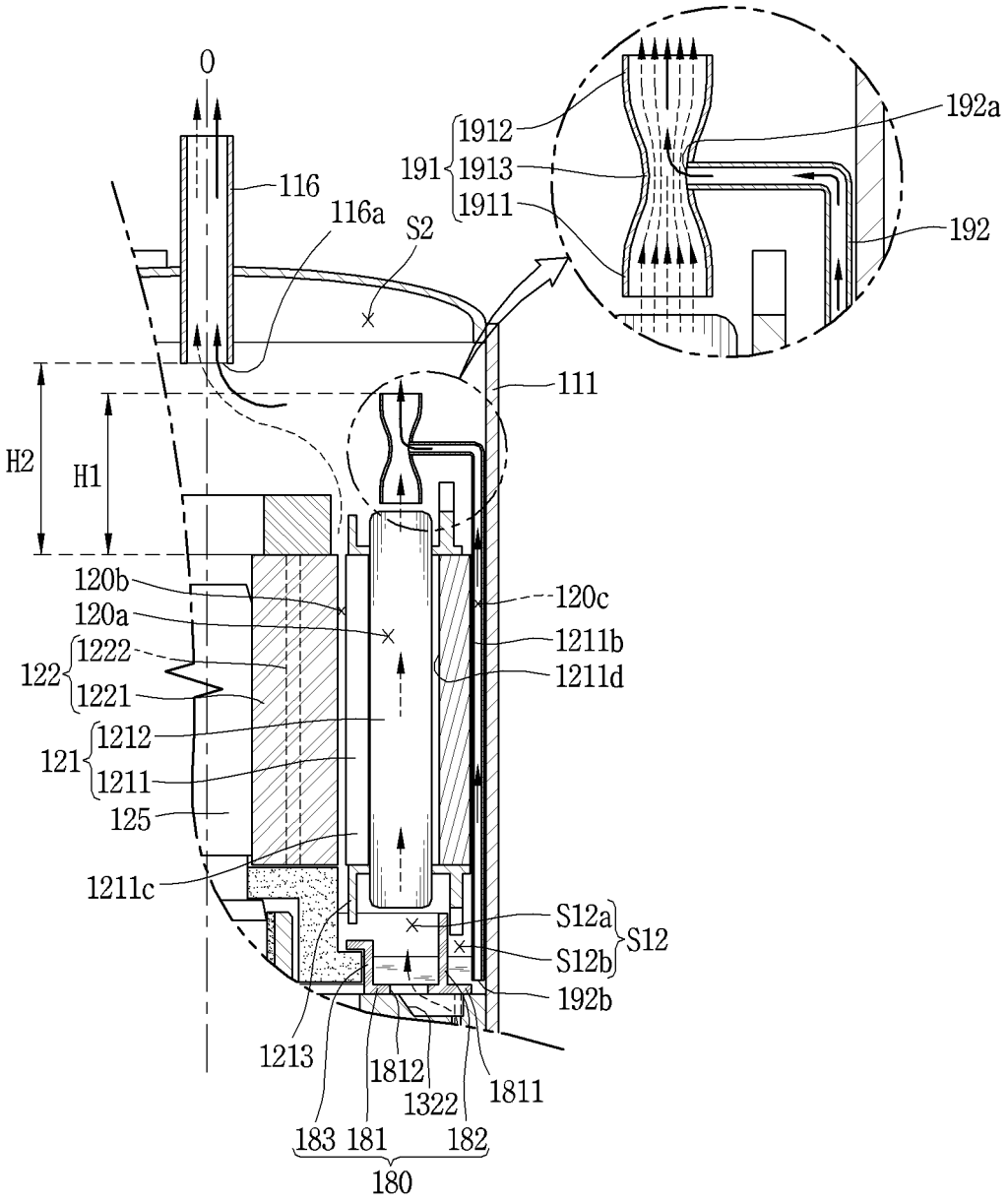
FIG. 3 is an enlarged sectional view of a surrounding of a liquid refrigerant discharge unit in FIG. 2.
Figure 4:
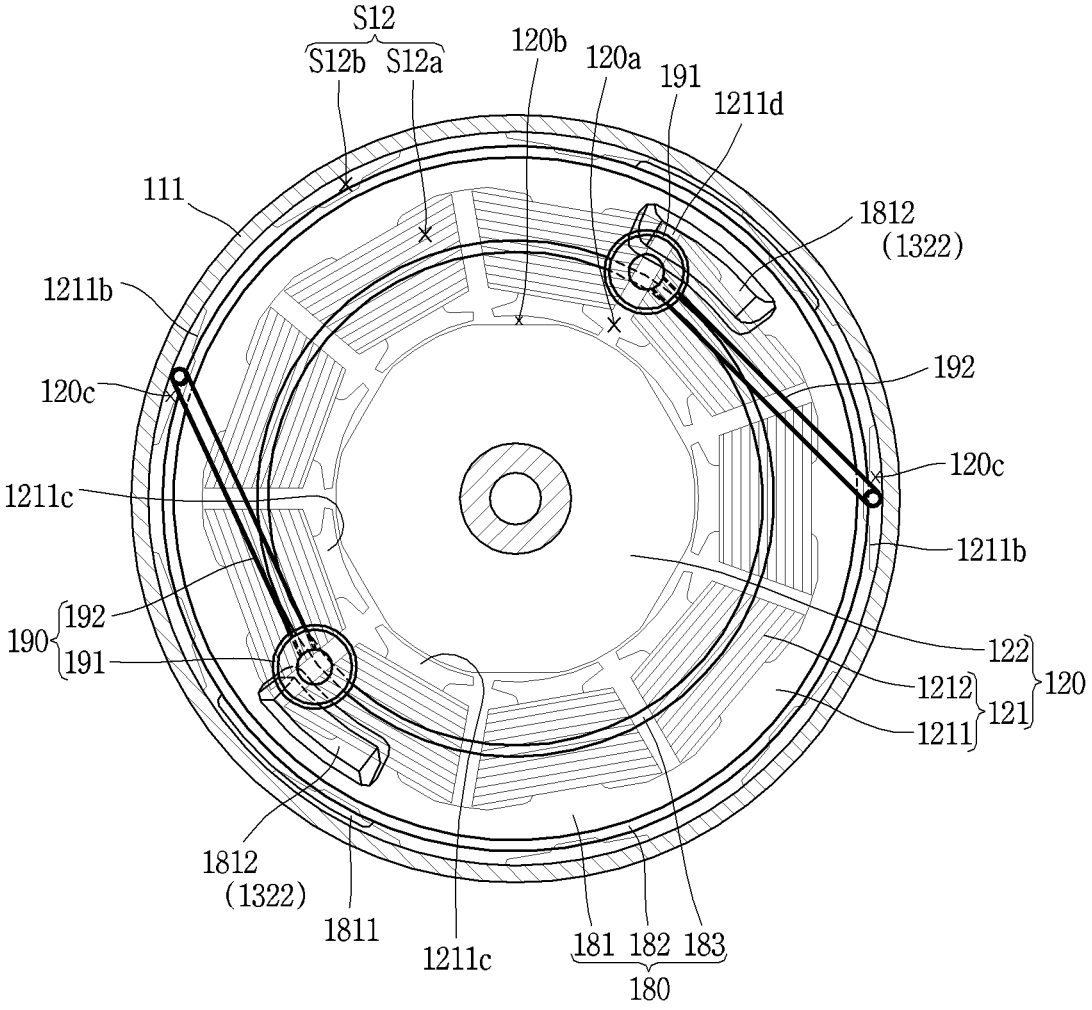
FIG. 4 is a horizontal sectional view illustrating an installation position of the liquid refrigerant discharge unit in FIG. 2.

FIG. 2 is a longitudinal sectional view of a bottom-compression type scroll compressor in accordance with an implementation, FIG. 3 is an enlarged sectional view of a surrounding of a liquid refrigerant discharge unit in FIG. 2, and FIG. 4 is a horizontal sectional view illustrating an installation position of the liquid refrigerant discharge unit in FIG. 2.

Referring to FIG. 2, a high-pressure and bottom-compression type scroll compressor (hereinafter, referred to as a scroll compressor) according to an implementation may include a driving motor 120 constituting a motor unit disposed in an upper portion of a casing 110, and a main frame 130, a fixed scroll 140, an orbiting scroll 150, and a discharge cover 160 sequentially disposed below the driving motor 120. In general, the driving motor 120 may constitute a motor unit, and the main frame 130, the fixed scroll 140, the orbiting scroll 150, and the discharge cover 160 may constitute a compression unit.

The motor unit may be coupled to an upper end of a rotating shaft 125 to be explained later, and the compression unit may be coupled to a lower end of the rotating shaft 125. Accordingly, the compressor may have the bottom-compression type structure described above, and the compression unit may be connected to the motor unit by the rotating shaft 125 to be operated by a rotational force of the motor unit.

Referring to FIG. 2, the casing 110 according to the implementation may include a cylindrical shell 111, an upper shell 112, and a lower shell 113. The cylindrical shell 112 may be formed in a cylindrical shape with upper and lower ends open. The upper shell 112 may be coupled to cover the opened upper end of the cylindrical shell 111. The lower shell 113 may be coupled to cover the opened lower end of the cylindrical shell 111. Accordingly, the inner space 110*a* of the casing 110 may be sealed. The sealed inner space 110*a* of the casing 110 may be divided into a lower space S1 and an upper space S2 based on the driving motor 120.

The lower space S1 may be a space defined below the driving motor 120. The lower space S1 may be further divided into an oil storage space S11 and a discharge space S12 with the compression unit therebetween.

The oil storage space S11 may be a space defined below the compression unit to store oil or mixed oil in which liquid refrigerant is mixed. The discharge space S12 may be a space defined between an upper surface of the compression unit and a lower surface of the driving motor 120. Refrigerant compressed in the compression unit or mixed refrigerant in which oil is contained may be discharged into the discharge space S12.

The upper space S2 may be a space defined above the driving motor 120 to form an oil separating space in which oil is separated from refrigerant discharged from the compression unit. The upper space S2 may communicate with the refrigerant discharge tube.

The driving motor 120 and the main frame 130 may be fixedly inserted into the cylindrical shell 111. An outer circumferential surface of the driving motor 120 and an outer circumferential surface of the main frame 130 may be respectively provided with an oil return passages Po1 and Po2 each spaced apart from an inner circumferential surface of the cylindrical shell 111 by a predetermined distance. This will be described again later together with the oil return passage.

A refrigerant suction tube 115 may be coupled through a side surface of the cylindrical shell 111. Accordingly, the refrigerant suction tube 115 may be coupled through the cylindrical shell 111 forming the casing 110 in a radial direction.

The refrigerant suction tube 115 may be formed in an L-like shape. One end of the refrigerant suction tube 115 may be inserted through the cylindrical shell 111 to directly communicate with a suction port 1421 of the fixed scroll 140, which configures the compression unit. Accordingly, refrigerant can be introduced into a compression chamber V through the refrigerant suction tube 115.

Another end of the refrigerant suction tube 115 may be connected to an accumulator 50 which defines a suction passage outside the cylindrical shell 111. The accumulator 50 may be connected to an outlet side of the evaporator 40 through a refrigerant tube. Accordingly, while refrigerant flows from the evaporator 40 to the accumulator 50, liquid refrigerant may be separated in the accumulator 50, and only gaseous refrigerant may be directly introduced into the compression chamber V through the refrigerant suction tube 115.

In some examples, a terminal bracket may be coupled to an upper portion of the cylindrical shell 111 or the upper shell 112, and a terminal for transmitting external power to the driving motor 120 may be coupled through the terminal bracket.

An inner end 116*a* of the refrigerant discharge tube 116 may be coupled through an upper portion of the upper shell 112 to communicate with the inner space 110*a* of the casing 110, specifically, the upper space S2 defined above the driving motor 120.

The refrigerant discharge tube 116 may correspond to a passage through which compressed refrigerant discharged from the compression unit to the inner space 110*a* of the casing 110 is externally discharged toward the condenser 20. The refrigerant discharge tube 116 may be disposed coaxially with the rotating shaft 125 to be described later. Accordingly, a venturi tube 191 to be described later disposed in parallel with the refrigerant discharge tube 116 may be eccentrically disposed with respect to an axial center of the rotating shaft 125.

The refrigerant discharge tube 116 may be provided therein with an oil separator for separating oil from refrigerant discharged from the compressor 10 to the condenser 20, or a check valve for suppressing refrigerant discharged from the compressor 10 from flowing back into the compressor 10.

One end portion of an oil circulation tube may be coupled through a lower end portion of the lower shell 113. Both ends of the oil circulation tube may be open, and another end portion of the oil circulation tube may be coupled through the refrigerant suction tube 115. An oil circulation valve may be installed in a middle portion of the oil circulation tube.

The oil circulation valve may be open or closed according to an amount of oil stored in the oil storage space S11 or according to a set condition. For example, the oil circulation valve may be open to circulate oil stored in the oil storage space to the compression unit through the suction refrigerant tube at the beginning of the operation of the compressor, while being closed to prevent an excessive outflow of oil within the compressor during a normal operation.

Hereinafter, a driving motor constituting the motor unit will be described.

Referring to FIG. 2, the driving motor 120 according to the implementation may include a stator 121 and a rotor 122. The stator 121 may be fixed onto the inner circumferential surface of the cylindrical shell 111, and the rotor 122 may be rotatably disposed in the stator 121.

The stator 121 may include a stator core 1211 and a stator coil 1212.

The stator core 1211 may be formed in an annular shape or a hollow cylindrical shape and may be shrink-fitted onto the inner circumferential surface of the cylindrical shell 111.

A rotor accommodating portion 1211*a* may be formed in a circular shape through a central portion of the stator core 1211 such that the rotor 122 can be rotatably inserted therein. A plurality of stator-side return grooves 1211*b* may be recessed or cut out in a D-cut shape at an outer circumferential surface of the stator core 1211 along the axial direction and disposed at preset distances along a circumferential direction.

A plurality of teeth 1211*c* and slots 1211*d* may be alternately formed on an inner circumferential surface of the rotor accommodating portion 1211*a* in the circumferential direction, and the stator coil 1212 may be wound on each tooth 1211*c* by passing through the slots 1211*d* at both sides of the tooth 1211*c*.

Each slot (precisely, a space between adjacent stator coils in the circumferential direction) 1211*d* may define an inner passage 120*a*, and a gap passage 120*b* may be defined between an inner circumferential surface of the stator core 1211 and an outer circumferential surface of the rotor core 1221. Each of the oil return grooves 1211*b* may define an outer passage 120*c*. The inner passages 120*a* and the gap passage 120*b* may define a passage through which refrigerant discharged from the compression unit moves to the upper space S2, and the outer passages 120*c* may define a first oil return passage Po1 through which oil separated in the upper space S2 is returned to the oil storage space S11.

The stator coil 1212 may be wound around the stator core 1211 and may be electrically connected to an external power source through a terminal that is coupled through the casing 110. An insulator 1213, which is an insulating member, may be inserted between the stator core 1211 and the stator coil 1212.

The insulator 1213 may be provided at an outer circumferential side and an inner circumferential side of the stator coil 1212 to accommodate a bundle of the stator coil 1212 in the radial direction, and may extend to both sides in the axial direction of the stator core 1211.

The rotor 122 may include a rotor core 1221 and permanent magnets 1222.

The rotor core 1221 may be formed in a cylindrical shape to be accommodated in the rotor accommodating portion 1211*a* defined in the central portion of the stator core 1211.

Specifically, the rotor core 1221 may be rotatably inserted into the rotor accommodating portion 1211*a* of the stator core 1211 with a predetermined gap 120*a* therebetween. The permanent magnets 1222 may be embedded in the rotor core 1222 at preset intervals along the circumferential direction.

A balance weight 123 may be coupled to a lower end of the rotor core 1221. Alternatively, the balance weight 123 may be coupled to a main shaft portion 1251 of the rotating shaft 125 to be described later. This implementation will be described based on an example in which the balance weight 123 is coupled to the rotating shaft 125. The balance weight 123 may be disposed on each of a lower end side and an upper end side of the rotor, and the two balance weights 123 may be installed symmetrically to each other.

The rotating shaft 125 may be coupled to the center of the stator core 1221. An upper end portion of the rotating shaft 125 may be press-fitted to the rotor 122, and a lower end portion of the rotating shaft 125 may be rotatably inserted into the main frame 130 to be supported in the radial direction.

The main frame 130 may be provided with a main bearing 171 configured as a bush bearing to support the lower end portion of the rotating shaft 125. Accordingly, a portion, which is inserted into the main frame 130, of the lower end portion of the rotating shaft 125 may smoothly rotate inside the main frame 130.

The rotating shaft 125 may transfer a rotational force of the driving motor 120 to an orbiting scroll 150 constituting the compression unit. Accordingly, the orbiting scroll 150 eccentrically coupled to the rotating shaft 125 may perform an orbiting motion with respect to the fixed scroll 140.

Referring to FIG. 2, the rotating shaft 125 according to the implementation may include a main shaft portion 1251, a first bearing portion 1252, a second bearing portion 1253, and an eccentric portion 1254.

The main shaft portion 1251 may be an upper portion of the rotating shaft 125 and may be formed in a cylindrical shape. The main shaft portion 1251 may be partially press-fitted into the stator core 1221.

The first bearing portion 1252 may be a portion extending from a lower end of the main shaft portion 1251. The first bearing portion 1252 may be inserted into a main bearing hole 1331 of the main frame 130 so as to be supported in the radial direction.

The second bearing portion 1253 may be a lower portion of the rotating shaft 125. The second bearing portion 1253 may be inserted into a sub bearing hole 143*a* of a fixed scroll 140 to be described later so as to be supported in the radial direction. A central axis of the second bearing portion 1253 and a central axis of the first bearing portion 1252 may be aligned on the same line. That is, the first bearing portion 1252 and the second bearing portion 1253 may have the same central axis.

The eccentric portion 1254 may be formed between a lower end of the first bearing portion 1252 and an upper end of the second bearing portion 1253. The eccentric portion 1254 may be inserted into a rotating shaft coupling portion 153 of the orbiting scroll 150 to be described later.

The eccentric portion 1254 may be eccentric with respect to the first bearing portion 1252 or the second bearing portion 1253 in the radial direction. That is, a central axis of the eccentric portion 1254 may be eccentric with respect to the central axis of the first bearing portion 1252 and the central axis of the second bearing portion 1253. Accordingly, when the rotating shaft 125 rotates, the orbiting scroll 150 may perform an orbiting motion with respect to the fixed scroll 140.

On the other hand, an oil supply passage 126 for supplying oil to the first bearing portion 1252, the second bearing portion 1253, and the eccentric portion 1254 may be formed in a hollow shape in the rotating shaft 125. The oil supply passage 126 may include an inner oil passage 1261 defined in the rotating shaft 125 along the axial direction.

As the compression unit is located below the motor unit 20, the inner oil passage 1261 may be formed in a grooving manner from the lower end of the rotating shaft 125 approximately to a lower end or a middle height of the stator 121 or up to a position higher than an upper end of the first bearing portion 1252. In some examples, the inner oil passage 1261 may alternatively be formed through the rotating shaft 125 in the axial direction.

An oil pickup 127 for pumping up oil filled in the oil storage space S11 may be coupled to the lower end of the rotating shaft 125, namely, a lower end of the second bearing portion 1253. The oil pickup 127 may include an oil supply tube 1271 inserted into the inner oil passage 1261 of the rotating shaft 125, and a blocking member 1272 accommodating the oil supply tube 1271 to block an introduction of foreign materials. The oil supply tube 1271 may extend downward through the discharge cover 160 to be immersed in the oil filled in the oil storage space S11.

The rotating shaft 125 may be provided with a plurality of oil supply holes communicating with the inner oil passage 1261 to guide oil moving upward along the inner oil passage 1261 toward the first and second bearing portions 1252 and 1253 and the eccentric portion 1254.

Hereinafter, the compression unit will be described.

Referring to FIG. 2, the compression unit according to the implementation may include a main frame 130, a fixed scroll 140, an orbiting scroll 150, a discharge cover 160, and a flow path guide 180.

The main frame 130 may include a frame end plate 131, a frame side wall 132, and a main bearing portion 133.

The frame end plate 131 may be formed in an annular shape and installed below the driving motor 120. The frame side wall 132 may extend in a cylindrical shape from an edge of a lower surface of the frame end plate 131, and an outer circumferential surface of the frame side wall 132 may be fixed to the inner circumferential surface of the cylindrical shell 111 in a shrink-fitting or welding manner. Accordingly, the oil storage space S11 and the discharge space S12 constituting the lower space S1 of the casing 110 may be separated from each other by the frame end plate 131 and the frame side wall 132.

A frame discharge hole (hereinafter, a second discharge hole) 1321 forming a part of a discharge passage may be formed through the frame side wall 132 in the axial direction. The second discharge hole 1321 may be formed to correspond to a scroll discharge hole (first discharge hole) 1422 of the fixed scroll 140 to be described later, to define a refrigerant discharge passage together with the first discharge hole 1422.

The second discharge hole 1321 may be elongated in the circumferential direction, or may be provided in plurality disposed at preset intervals along the circumferential direction. Accordingly, the second discharge hole 1321 can secure a volume of a compression chamber relative to the same diameter of the main frame 130 by maintaining a minimum radial width with securing a discharge area. This may equally be applied to the first discharge hole 1422 that is formed in the fixed scroll 140 to define a part of the discharge passage.

A discharge guide groove 1322 to accommodate the plurality of second discharge holes 132*a* may be formed in an upper end of the second discharge hole 1321, namely, an upper surface of the frame end plate 131. At least one discharge guide groove 1322 may be formed according to positions of the second discharge holes 1321. For example, when the second discharge holes 1321 form three groups, the number of discharge guide grooves 1322 may be three to accommodate the three groups of second discharge holes 1321, respectively. The three discharge guide grooves 1322 may be located on the same line in the circumferential direction.

The discharge guide groove 1322 may be formed wider than the second discharge hole 1321. For example, the second discharge hole 1321 may be formed on the same line in the circumferential direction together with a first oil return groove 1323 to be described later. Therefore, when a flow path guide 180 to be described later is provided, the second discharge hole 1321 having a small cross-sectional area may be difficult to be located at an inner side of the flow path guide 180. With this reason, the discharge guide groove 1322 may be formed at an end portion of the second discharge hole 1321 while an inner circumferential side of the discharge guide groove 1322 extends radially up to the inner side of the flow path guide 180.

Accordingly, the second discharge hole 1321 can be located adjacent to the outer circumferential surface of the main frame 130 by reducing an inner diameter of the second discharge hole 1321, and simultaneously can be prevented from being located at an outer side of the flow path guide 180, namely, adjacent to the outer circumferential surface of the stator 121.

A frame oil return groove (hereinafter, first oil return groove) 1323 that defines a part of a second oil return passage Po2 may be formed axially through an outer circumferential surface of the frame end plate 131 and an outer circumferential surface of the frame side wall 132 that define the outer circumferential surface of the main frame 130. The first oil return groove 1323 may be provided by only one or may be provided in plurality disposed in the outer circumferential surface of the main frame 130 at preset intervals in the circumferential direction. Accordingly, the discharge space S12 of the casing 110 can communicate with the oil storage space S11 of the casing 110 through the first oil return groove 1323.

The first oil return groove 1323 may be formed to correspond to a scroll oil return groove (hereinafter, second oil return groove) 1423 of the fixed scroll 140, which will be described later, and define the second oil return passage together with the second oil return groove 1423 of the fixed scroll 140.

The main bearing portion 133 may protrude upward from an upper surface of a central portion of the frame end plate 131 toward the driving motor 120. The main bearing portion 133 may be provided with a main bearing hole 1331 formed therethrough in a cylindrical shape along the axial direction. The first bearing portion 1252 of the rotating shaft 125 may be inserted into the main bearing hole 1331 to be supported in the radial direction.

Hereinafter, the fixed scroll will be described.

Referring to FIG. 2, the fixed scroll 140 according to the implementation may include a fixed end plate 141, a fixed side wall 142, a sub bearing portion 143, and a fixed wrap 144.

The fixed end plate 141 may be formed in a disk shape having a plurality of concave portions on an outer circumferential surface thereof, and a sub bearing hole 1431 defining the sub bearing portion 143 to be described later may be formed through a center of the fixed end plate 141 in the vertical direction. Discharge ports 1411 and 1412 may be formed around the sub bearing hole 1431. The discharge ports 1411 and 1412 may communicate with a discharge pressure chamber Vd so that compressed refrigerant is moved into the discharge space S12 of the discharge cover 160 to be explained later.

In some examples, only one discharge port may be provided to communicate with both of a first compression chamber V1 and a second compression chamber V2 to be described later. In the implementation, however, a first discharge port may communicate with the first compression chamber V1 and a second discharge port may communicate with the second compression chamber V2. Accordingly, refrigerant compressed in the first compression chamber V1 and refrigerant compressed in the second compression chamber V2 may be independently discharged through the different discharge ports.

The fixed side wall 142 may extend in an annular shape from an edge of an upper surface of the fixed end plate 141 in the vertical direction. The fixed side wall 142 may be coupled to face the frame side wall 132 of the main frame 130 in the vertical direction.

A scroll discharge hole (hereinafter, first discharge hole) 1422 may be formed through the fixed side wall 142 in the axial direction. The first discharge hole 1422 may be elongated in the circumferential direction, or may be provided in plurality disposed at preset intervals along the circumferential direction. Accordingly, the first discharge hole 1422 can secure a volume of a compression chamber relative to the same diameter of the fixed scroll 140 by maintaining a minimum radial width with securing a discharge area.

The first discharge hole 1422 may communicate with the second discharge hole 1321 in a state in which the fixed scroll 140 is coupled to the cylindrical shell 111. Accordingly, the first discharge hole 1422 can define a refrigerant discharge passage together with the second discharge hole 1321.

A second oil return groove 1423 may be formed in an outer circumferential surface of the fixed side wall 142. The second oil return groove 1423 may communicate with the first oil return groove 1323 provided at the main frame 130 to guide oil returned along the first oil return groove 1323 to the oil storage space S11. Accordingly, the first oil return groove 1323 and the second oil return groove 1423 may define the second oil return passage Po2 together with an oil return groove 1612 of the discharge cover 160 to be described later.

The fixed side wall 142 may be provided with a suction port 1421 formed through the fixed side wall 142 in the radial direction. An end portion of the refrigerant suction tube 115 inserted through the cylindrical shell 111 may be inserted into the suction port 1421. Accordingly, refrigerant can be introduced into a compression chamber V through the refrigerant suction tube 115.

The sub bearing portion 143 may extend in the axial direction from a central portion of the fixed end plate 141 toward the discharge cover 160. A sub bearing hole 1431 having a cylindrical shape may be formed through a center of the sub bearing portion 143 in the axial direction, and the second bearing portion 1253 of the rotating shaft 125 may be inserted into the sub bearing hole 1431 to be supported in the radial direction. Therefore, the lower end (or the second bearing portion) of the rotating shaft 125 can be radially supported by being inserted into the sub bearing portion 143 of the fixed scroll 140, and the eccentric portion 1254 of the rotating shaft 125 can be supported in the axial direction by an upper surface of the fixed end plate 141 defining the surrounding of the sub bearing portion 143.

A fixed wrap 144 may extend from the upper surface of the fixed end plate 141 toward the orbiting scroll 150 in the axial direction. The fixed wrap 144 may be engaged with an orbiting wrap 152 to be described later to define the compression chamber V. The fixed wrap 144 will be described later together with the orbiting wrap 152.

Hereinafter, the orbiting scroll will be described.

Referring to FIG. 2, the orbiting scroll 150 according to the implementation may include an orbiting end plate 151, an orbiting wrap 152, and a rotating shaft coupling portion 153.

The orbiting end plate 151 may be formed in a disk shape and accommodated in the main frame 130. An upper surface of the orbiting end plate 151 may be supported in the axial direction by the main frame 130 with interposing a back pressure sealing member therebetween.

The orbiting wrap 152 may extend from a lower surface of the orbiting end plate 151 toward the fixed scroll 140. The orbiting wrap 152 may be engaged with the fixed wrap 144 to define the compression chamber V.

The orbiting wrap 152 may be formed in an involute shape together with the fixed wrap 144. However, the orbiting wrap 152 and the fixed wrap 144 may be formed in various shapes other than the involute shape.

For example, the orbiting wrap 152 may be formed in a substantially elliptical shape in which a plurality of arcs having different diameters and origins are connected and the outermost curve may have a major axis and a minor axis. The fixed wrap 144 may also be formed in a similar manner.

An inner end portion of the orbiting wrap 152 may be formed at a central portion of the orbiting end plate 151, and the rotating shaft coupling portion 153 may be formed through the central portion of the orbiting end plate 151 in the axial direction.

The eccentric portion 1254 of the rotating shaft 125 may be rotatably inserted into the rotating shaft coupling portion 153. An outer circumferential part of the rotating shaft coupling portion 153 may be connected to the orbiting wrap 152 to define the compression chamber V together with the fixed wrap 144 during a compression process.

The rotating shaft coupling portion 153 may be formed at a height at which it overlaps the orbiting wrap 152 on the same plane. That is, the rotating shaft coupling portion 153 may be disposed at a height at which the eccentric portion 1254 of the rotating shaft 125 overlaps the orbiting wrap 152 on the same plane. Accordingly, repulsive force and compressive force of refrigerant can cancel each other while being applied to the same plane based on the orbiting end plate 151, and thus inclination of the orbiting scroll 150 due to interaction between the compressive force and the repulsive force can be suppressed.

On the other hand, the compression chamber V may be formed in a space defined by the fixed end plate 141, the fixed wrap 144, the orbiting end plate 151, and the orbiting wrap 152. The compression chamber V may include a first compression chamber V1 defined between an inner surface of the fixed wrap 144 and an outer surface of the orbiting wrap 152, and a second compression chamber V2 defined between an outer surface of the fixed wrap 144 and an inner surface of the orbiting wrap 152.

Hereinafter, the discharge cover will be described.

Referring to FIG. 2, the discharge cover 160 may include a cover housing portion 161 and a cover flange portion 162.

The cover housing portion 161 may have a cover space 1611 defining the discharge space S3 together with the lower surface of the fixed scroll 140.

An outer circumferential surface of the cover housing portion 161 may come in close contact with the inner circumferential surface of the casing 110. Here, a portion of the cover housing portion 161 may be spaced apart from the casing 110 in the circumferential direction to define an oil return groove 1612. The oil return groove 1612 may define a third oil return groove together with an oil return groove 1621 formed in an outer circumferential surface of the cover flange portion 162. The third oil return groove 1612 of the discharge cover 160 may define the second oil return passage Po2 together with the first oil return groove of the main frame 130 and the second oil return groove of the fixed scroll 140.

At least one discharge hole accommodating groove 1613 may be formed in an inner circumferential surface of the cover housing portion 161 in the circumferential direction. The discharge hole accommodating groove 1613 may be recessed outward in the radial direction, and the first discharge hole 1422 of the fixed scroll 140 defining the discharge passage may be located inside the discharge hole accommodating groove 1613. Accordingly, an inner surface of the cover housing portion 161 excluding the discharge hole accommodating groove 1613 may be brought into close contact with an outer circumferential surface of the fixed scroll 140, namely, an outer circumferential surface of the fixed end plate 141 so as to configure a type of sealing part.

An entire circumferential angle of the discharge hole accommodating groove 1613 may be formed to be smaller than or equal to an entire circumferential angle with respect to an inner circumferential surface of the discharge space S3 except for the discharge hole accommodating groove 1613. In this manner, the inner circumferential surface of the discharge space S3 except for the discharge hole accommodating groove 1613 can secure not only a sufficient sealing area but also a circumferential length for forming the cover flange portion 162.

The cover flange portion 162 may extend radially from a portion defining the sealing part, namely, an outer circumferential surface of a portion, excluding the discharge hole accommodating groove 1613, of an upper surface of the cover housing portion 161.

The cover flange portion 162 may be provided with coupling holes for coupling the discharge cover 160 to the fixed scroll 140 with bolts, and a plurality of oil return grooves 1621 may be formed in a radially recessed manner at preset intervals along the circumferential direction between the adjacent coupling holes. The oil return groove 1621 may define the third oil return groove together with the oil return groove 1612 of the cover housing portion 161.

Hereinafter, the flow path guide will be described.

Referring to FIGS. 2 and 3, the flow path guide 180 according to this implementation may be installed between the motor unit and the compression unit, for example, in the discharge space S12. Specifically, the flow path guide 180 may be disposed at the upper end of the main frame 130 that faces the lower end of the driving motor 120.

The flow path guide 180 may divide the discharge space S12 into a refrigerant discharge flow path and an oil return flow path. Accordingly, refrigerant discharged from the compression unit to the discharge space S12 may move to the upper space S2 through the inner passages 120*a* and the gap passage 120*b*. Oil separated from the refrigerant in the upper space S2 may be returned to the oil storage space S11 through the outer passages 120*c*.

The flow path guide 180 may be formed in a single annular shape or may be formed in a shape defined by a plurality of arcuate parts. Hereinafter, an example in which the flow path guide 180 is formed in a single annular shape will be mainly described, but even when it is formed in a shape defined by a plurality of arcuate parts, the basic configuration for separating refrigerant and oil and operating effects thereof may be similar.

For example, the flow path guide 180 may include a bottom portion 181, an outer wall 182, and an inner wall 183.

The bottom portion 181 may be formed in an annular shape and fixed to the upper surface of the main frame 130. A discharge passage cover portion 1811 may radially extend from an outer circumferential surface of the bottom portion 181. A discharge through hole 1812 may be formed through the discharge passage cover portion 1811 to overlap the discharge guide groove 1322 of the main frame 130.

The outer wall 182 may extend from a substantially outer circumferential surface of the bottom portion 181 toward the insulator 1213. The outer wall 182 may be fitted to an inner side or outer side of the insulator 1213 to overlap the insulator 1213. The outer wall 182 may be formed in an annular shape extending in the circumferential direction or may be formed in an arcuate shape.

When the outer wall 182 is formed in an annular shape, a diameter of the outer wall 182 may be smaller or larger than a diameter of the insulator 1213 or an upper end of the outer wall 182 may be spaced apart from a lower end of the insulator 1213. Accordingly, a gap may be formed between the outer wall 182 and the insulator 1213, such that refrigerant (liquid refrigerant) discharged to the inner side of the outer wall 182 can move toward an outer space S12*b* in which a second end 192*b* of a liquid refrigerant discharge tube 192 to be explained later is located. This can allow the liquid refrigerant to be rapidly discharged to the outside of the compressor through a liquid refrigerant discharge unit 190.

In some examples, when a communication path such as the gap is not formed between the annular outer wall 182 and the insulator 1213, a communication groove through which an inner space S12*a* and the outer space S12*b* communicate with each other may be formed in the bottom portion 181 or the main frame 130 facing the bottom portion 181.

The inner wall 183 may extend from a substantially inner circumferential surface of the bottom portion 181 toward the insulator 1213. The inner wall 183 may extend in the axial direction or may extend by being bent to cover the balance weight 123.

Meanwhile, referring to FIGS. 2 to 4, a liquid refrigerant discharge unit 190 for discharging liquid refrigerant stagnated in the inner space 110*a* of the casing 110 to the refrigerant discharge tube 116 may be disposed inside the casing 110. The liquid refrigerant discharge unit 190 may include a venturi tube 191 and a liquid refrigerant discharge tube 192 connected to a small-diameter portion 1913 of the venturi tube 191.

The venturi tube 191 may be separately installed between the driving motor 120 and the refrigerant discharge tube 116 inside the casing 110 or may be configured by using the refrigerant discharge tube 116. Hereinafter, a description will be given of an example of installing the venturi tube 191 separately which is a first implementation, and an example using the refrigerant discharge tube 116 which is a second implementation. The first and second implementations will be described again later.

In the drawings, unexplained reference numeral 21 denotes a condenser fan, and 41 denotes an evaporator fan.

The scroll compressor according to the implementation of the present disclosure may operate as follows.

That is, when power is applied to the motor unit 120, rotational force may be generated and the rotor 122 and the rotating shaft 50 may rotate accordingly. As the rotating shaft 50 rotates, the orbiting scroll 170 eccentrically coupled to the rotating shaft 50 may perform an orbiting motion relative to the fixed scroll 140 by the Oldham ring 140.

Accordingly, the volume of the compression chamber V may decrease gradually along a suction pressure chamber Vs defined at an outer side of the compression chamber V, an intermediate pressure chamber Vm continuously formed toward a center, and a discharge pressure chamber Vd defined in a central portion.

Then, refrigerant may move to the accumulator 50 sequentially via the condenser 20, the expander 30, and the evaporator 40 of the refrigeration cycle system. The refrigerant may flow toward the suction pressure chamber Vs forming the compression chamber V through the refrigerant suction tube 115.

The refrigerant suctioned into the suction pressure chamber Vs may be compressed while moving to the discharge pressure chamber Vd via the intermediate pressure chamber Vm along a movement trajectory of the compression chamber V. The compressed refrigerant may be discharged from the discharge pressure chamber Vd to the discharge space S12 of the discharge cover 60 through the discharge ports 1411 and 1412.

Then, the refrigerant (refrigerant is oil-mixed refrigerant, but in description, mixed refrigerant or refrigerant will all be used) that has been discharged to the discharge space S12 of the discharge cover 160 may move to the discharge space S12 defined between the main frame 130 and the driving motor 120 through the discharge hole accommodating groove 1613 of the discharge cover 160 and the first discharge hole 1422 of the fixed scroll 140. The mixed refrigerant may pass through the driving motor 120 to move to the upper space S2 of the casing 110 defined above the driving motor 120.

The mixed refrigerant moved to the upper space S2 may be separated into refrigerant and oil in the upper space S2. The refrigerant (or some mixed refrigerant from which oil is not separated) may be discharged out of the casing 110 through the refrigerant discharge tube 116 so as to move to the condenser 20 of the refrigeration cycle system.

On the other hand, the oil separated from the refrigerant in the upper space S2 (or mixed oil with liquid refrigerant) may move to the lower space S1 along the first oil return passage Po1 between the inner circumferential surface of the casing 110 and the stator 121. The oil moved to the lower space S1 may be returned to the oil storage space S11 defined in the lower portion of the compression unit along the second oil return passage Po2 between the inner circumferential surface of the casing 10 and the outer circumferential surface of the compression unit.

This oil may thusly be supplied to each bearing surface through the oil supply passage 126, and partially supplied into the compression chamber V. Oil supplied to bearing surfaces and the compression chamber V may be discharged to the discharge cover 160 together with refrigerant and then returned. This series of processes may be repeatedly performed.

At this time, as the flow path guide 180 by which the refrigerant discharge passage and the oil return passage are separated is disposed in a space, namely, the discharge space S12 defined between the lower end of the driving motor 120 and the upper end of the main frame 130, the refrigerant that is discharged from the compression unit and moves toward the upper space S2 can be suppressed from being mixed with the oil moving from the upper space S2 to the lower space S1.

Meanwhile, as described above, when the compressor is started, liquid refrigerant may excessively stagnate in the inner space of the casing. This problem may occur more severely due to a delay of a point of time at which an internal temperature of the compressor reaches an oil superheat when an outdoor unit including a large compressor, such as an air conditioner, is exposed to a low-temperature stop state for a long time.

When the liquid refrigerant excessively stagnates in the inner space of the compressor, viscosity of oil mixed in the liquid refrigerant may be lowered, which may cause friction loss and wear on the compression unit and the bearing surfaces during the initial operation of the compressor. In addition, when the internal temperature of the compressor reaches the oil superheat, a large amount of liquid refrigerant may be vaporized and flow out together with oil to the outside of the compressor, which may further aggravate the friction loss and wear on the compression unit and the bearing surfaces.

Accordingly, in this implementation, a liquid refrigerant discharging device for discharging liquid refrigerant from the inner space of the casing may be installed so that the liquid refrigerant does not stagnate inside the compressor. The liquid refrigerant discharging device according to this implementation may be installed in the inner space of the casing. Hereinafter, the liquid refrigerant discharging device will be defined as the liquid refrigerant discharge unit 190 and a description thereof will be given.

Referring to FIGS. 3 and 4 again, the liquid refrigerant discharge unit 190 according to the implementation may include a venturi tube 191 and a liquid refrigerant discharge tube 192.

The venturi tube 191 may be disposed between the upper end of the driving motor 120 and the refrigerant discharge tube 116, to be in parallel to an axial center O of the rotating shaft 125 at a position eccentric from the axial center of the rotating shaft 125 by a preset distance. For example, a lower end of the venturi tube 191 facing the drive motor 120 may be spaced apart from the upper end of the stator coil 1212 constituting a part of the driving motor 120 by a preset distance, and an upper end of the venturi tube 191 (linearly or obliquely) facing the refrigerant discharge tube 116 may be spaced apart from the inner circumferential surface of the upper shell 112 by a preset distance.

Specifically, the venturi tube 191 may be formed in a hollow shape with both ends open. For example, the venturi tube 191 may include a first large-diameter portion 1911 and a second large-diameter portion 1912 formed at both ends thereof to define a first open end and a second open end, respectively, and at least one small-diameter portion 1913 formed between the first large-diameter portion 1911 and the second large-diameter portion 1912. In this implementation, an example in which one small-diameter portion 1913 is provided will be mainly described. Also, for convenience of explanation, the first large-diameter portion 1911 may be defined as an inlet of the venturi tube 191 open toward the driving motor 120 and the second large-diameter portion 1912 may be defined as an outlet of the venturi tube 191 open toward the refrigerant discharge tube 116.

A lower end of the first large-diameter portion 1911 may face the stator coil 1212 and also may be located at a position where a flow rate of refrigerant is the fastest in the upper space S2 of the casing 110. This can enhance a venturi effect in the venturi tube 191.

In other words, a lower end of the first large-diameter portion 1911 may at least partially overlap the inner passage 120*a* between the adjacent stator coils (coil bundles) 1212 in the driving motor 120, and the lower end of the inner passage 120*a* may at least partially overlap the discharge through hole 1812 of the flow path guide 180 (or the discharge guide groove of the main frame), which is open toward the discharge space S12 in the compression unit. Since the first large-diameter portion 1911 overlaps the discharge through hole 1812 of the flow path guide 180 in the axial direction through the inner passage 120*a*, the first large-diameter portion 1911 can be located at the position where the flow rate of the refrigerant is the fastest. Accordingly, some of refrigerant flowing through the discharge through hole 1812 of the flow path guide 180 and the inner passage 120*a* between the stator coils 1212 can be quickly introduced into the venturi tube 191, thereby enhancing a liquid refrigerant suction effect in the venturi tube 191.

The first large-diameter portion 1911 may have a circular cross section. However, in some cases, it may have a rectangular or arcuate cross section. For example, when the first large-diameter portion 1911 is formed in the rectangular shape, the first large-diameter portion 1911 may be formed to overlap the plurality of slots (more precisely, the inner passages) adjacent to each other. Accordingly, a larger amount of refrigerant can be introduced into the venturi tube 191.

The first large-diameter portion 1911 may have a cross-sectional area that is larger than or equal to a cross-sectional area of one slot (to be precise, one inner passage) 1211*d*. With the configuration, the refrigerant flowing toward the upper space S2 through the slots 1211*d* can be guided not to flow aside the venturi tube 191, thereby increasing an introduction of the refrigerant into the venturi tube 191.

The first large-diameter portion 1911 may have a cross-sectional area larger than that of the small-diameter portion 1913 and equal to that of the second large-diameter portion 1912. This can facilitate the manufacturing of the venturi tube 191. However, it may not be always necessary that the cross-sectional area of the first large-diameter portion 1911 is the same as that of the second large-diameter portion 1912. For example, the first large-diameter portion 1911 may have an inner diameter that is larger than an inner diameter of the second large-diameter portion 1912. This can allow more refrigerant moving to the upper space S2 to be introduced into the venturi tube 191, so as to increase the flow rate of the refrigerant.

The second large-diameter portion 1912 may be formed to be symmetrical with the first large-diameter portion 1911 based on the small-diameter portion 1913. This can facilitate the manufacturing of the venturi tube 191. However, it may not be always necessary that the second large-diameter portion 1912 is symmetrical with the first large-diameter portion 1911 based on the small-diameter portion 1913. For example, the first large-diameter portion 1911 may be formed to have a rectangular cross-section but the second large-diameter portion 1912 may be formed to have a circular cross-section to correspond to the refrigerant discharge tube 116. Accordingly, a larger amount of refrigerant can flow into the first large-diameter portion 1911 while refrigerant passing through the second large-diameter portion 1912 can flow toward the refrigerant discharge tube 116 without leakage (while minimizing leakage).

The second large-diameter portion 1912 may be formed on the same axis (coaxially) with the small-diameter portion 1913 and/or the first large-diameter portion 1911. This can reduce flow resistance that is caused when the refrigerant having passed through the first large-diameter portion 1911 and the small-diameter portion 1913 flows into the second large-diameter portion 1912 or flows through the second large-diameter portion 1912. In this case, an end surface of the second large-diameter portion 1912 may be cut to be inclined or stepped toward the refrigerant discharge tube 116. Accordingly, the refrigerant passing through the second large-diameter portion 1912 can flow to the refrigerant discharge tube 116 more quickly.

However, it may not be always necessary that the second large-diameter portion 1912 is formed on the same axis as the first large-diameter portion 1911 based on the small-diameter portion 1913. For example, the second large-diameter portion 1912 may be in parallel with the first large-diameter portion 1911. In this case, the first large-diameter portion 1911 or the second large-diameter portion 1912 may be bent or the small-diameter portion 1913 may be bent. This will be described again later in another implementation.

An upper end of the second large-diameter portion 1912 may preferably be lower than or equal to an inner end of the refrigerant discharge tube 116. For example, based on the upper end of the driving motor 120 (stator core or rotor core), a first spacing height H1 from the upper end of the stator core 1211 to the upper end (second open end) of the second large-diameter portion 1912 may be lower than or equal to a second spacing height H2 from the upper end of the stator core 1211 to the inner end 116*a* of the refrigerant discharge tube 116. Accordingly, the refrigerant passing through the second large-diameter portion 1912 can flow to the refrigerant discharge tube 116 quickly.

On the other hand, the small-diameter portion 1913 may have a cross-sectional area that is smaller than the cross-sectional area of the first large-diameter portion 1911 and/or the second large-diameter portion 1912. Both ends of the small-diameter portion 1913 may be connected to the first large-diameter portion 1911 and the second large-diameter portion 1912, respectively. Here, a connected portion between the small-diameter portion 1913 and the first large-diameter portion 1911 and a connected portion between the small-diameter portion 1913 and the second large-diameter portion 1912 may preferably be curved to smooth the flow of fluid.

The small-diameter portion 1913 may communicate with an upper end (first end) 192*a* of a liquid refrigerant discharge tube 192 to be described later. The inner diameter of the small-diameter portion 1913 may be almost the same as that of the liquid refrigerant discharge tube 192. Accordingly, the liquid refrigerant suctioned into the venturi tube 191 through the liquid refrigerant discharge tube 192 can be mixed with refrigerant, which flows from the first large-diameter portion 1911 to the second large-diameter portion 1912 of the venturi tube 191, and then quickly discharged into the refrigerant discharge tube 116.

The liquid refrigerant discharge tube 192 according to this implementation may be configured as a smooth tube having a circular cross section and a single inner diameter. However, in some cases, the liquid refrigerant discharge tube 192 may be configured as a tube having a non-circular cross section and a plurality of inner diameters. For example, the liquid refrigerant discharge tube 192 may have a rectangular or triangular cross section to correspond to the shape of the oil return groove 1211*b* of the stator core 1211. Here, a first end 192*a* of the liquid refrigerant discharge tube 192 connected to the small-diameter portion 1913 may have a small inner diameter and a second end 192*b* as another end may have a large inner diameter.

The first end 192*a* of the liquid refrigerant discharge tube 192 may be connected to the venturi tube 191 as described above, and the second end 192*b* may communicate with the discharge space S12 through the driving motor 120. For example, the first end 192*a* may be connected to the small-diameter portion 1913 of the venturi tube 191 in the upper space and the second end 192*b* may communicate with the discharge space S12, more precisely, the outer space through the oil return groove 1211*b* of the stator core 1211. Accordingly, when the liquid refrigerant stagnates up to an upper side of the compression unit, namely, the discharge space S12, the liquid refrigerant can be suctioned into the venturi tube 191 through the liquid refrigerant discharge tube 192, move toward the upper space together with refrigerant inside the venturi tube 191, and then flow out of the casing through the refrigerant discharge tube 116.

In some cases, the second end 192*b* of the liquid refrigerant discharge tube 192 may be inserted up to a position where it partially overlaps the compression unit in the axial direction, that is, into the first oil return groove 1323 of the main frame 130 or the second oil return groove 1423 of the fixed scroll 140. However, in this case, oil returned or stored in the inner space 110*a* of the casing 110 may leak. Therefore, the second end 192*b* of the liquid refrigerant discharge tube 192 may preferably be located as low as possible within a range in which oil returned or stored in the inner space 110*a* of the casing 110 does not leak out.

In some examples, the second end 192*b* of the liquid refrigerant discharge tube 192 may be inserted into the upper end of the oil return groove 1211*b* without passing through the oil return groove 1911*b* of the stator core 1211. In this case, the oil return groove 1211*b* to which the second end 192*b* of the liquid refrigerant discharge tube 192 is connected may serve as a liquid refrigerant discharge tube.

The second end 192*b* of the liquid refrigerant discharge tube 192 may preferably be located, if possible, at a position where a flow rate of fluid (liquid refrigerant) is the slowest, that is, a position where the liquid refrigerant is likely to stagnate the most. For example, the second end 192*b* of the liquid refrigerant discharge tube 192 may be located furthest from the discharge through hole (or discharge guide groove) 1812 of the refrigerant. Specifically, when there are a plurality of discharge through holes 1812, the second end 192*b* of the liquid refrigerant discharge tube 192 may be disposed between the plurality of discharge through holes 1812 at a position where it does not overlap the discharge through holes 1812 in the circumferential direction.

Hereinafter, a description will be given of operating effects of the liquid refrigerant discharge unit according to the implementation of the present disclosure.

That is, as described above, at the initial operation of the compressor 10 that is exposed to a low-temperature stop state, a large amount of liquid refrigerant may be introduced into the compression unit together with gas refrigerant and oil, and discharged into the inner space S12*a* of the discharge space S12 that is located in the inner space 110*a* of the casing 110, namely, between the motor unit and the compression unit.

Some of the liquid refrigerant discharged into the inner space S12*a* together with the gas refrigerant and oil may move to the outer space S12*b* through a communication path disposed in the flow path guide or a communication groove disposed between the lower surface of the flow path guide 180 and the upper surface of the compression unit. This liquid refrigerant may then stagnate in the lower space S1 of the casing 110 including the oil storage space S11 and the discharge space S12 through the series of processes that the liquid refrigerant moves to the oil storage space s11 together with returned oil.

On the other hand, the gas refrigerant, the oil, and some of the liquid refrigerant, discharged to the discharge space S12, may mainly flow toward the upper space S2 of the casing 110 through the inner passage 120*a*. Some of this fluid may be accelerated while flowing through the venturi tube 191 disposed in the upper space S2. This acceleration force may allow the liquid refrigerant in the discharge space S12, in which the second end 192*b* of the liquid refrigerant discharge tube 192 is located, to be suctioned toward the venturi tube 191.

At this time, the gas refrigerant and the like may move toward the upper space S2 while maintaining the fastest speed through several inner passages 120*a*, which are located coaxially with or adjacent to the discharge through hole 1812 among the inner passages 120*a*. Accordingly, when the venturi tube 191 overlaps the corresponding inner passages 120*a* in the axial direction as illustrated in this implementation, the liquid refrigerant within the discharge space S12 can be more quickly suctioned toward the upper space S2 by the gas refrigerant and the like that pass through the venturi tube 191 at the fast speed.

Then, the liquid refrigerant stagnated in the inner space 110*a* of the casing 110 through the liquid refrigerant discharge tube 192 connected to the small-diameter portion 1913 of the venturi tube 191 may be suctioned into refrigerant passing through the venturi tube 191, thereby being discharged to the outside of the compressor 10. This can suppress an excessive amount of liquid refrigerant from remaining in the inner space 110*a* of the casing 110, thereby preventing viscosity of oil within the casing 110 from being lowered.

This can also suppress the discharge of oil mixed with vaporized refrigerant during a normal operation. Accordingly, even if the compressor 10 is restarted after being exposed to a low-temperature state for a long time, a predetermined amount of oil or more can be secured in the casing 110 at the initial operation, thereby suppressing friction loss and wear due to a shortage of oil in the compressor 10. In addition, when the air conditioner is re-operated, heating and cooling can be quickly resumed, thereby increasing satisfaction with use.

Hereinafter, a description will be given of another implementation of a liquid refrigerant discharge unit.

That is, the venturi tube is formed in the linear shape in the previous implementation but may also be formed in a bent shape in some cases.

Figure 5:
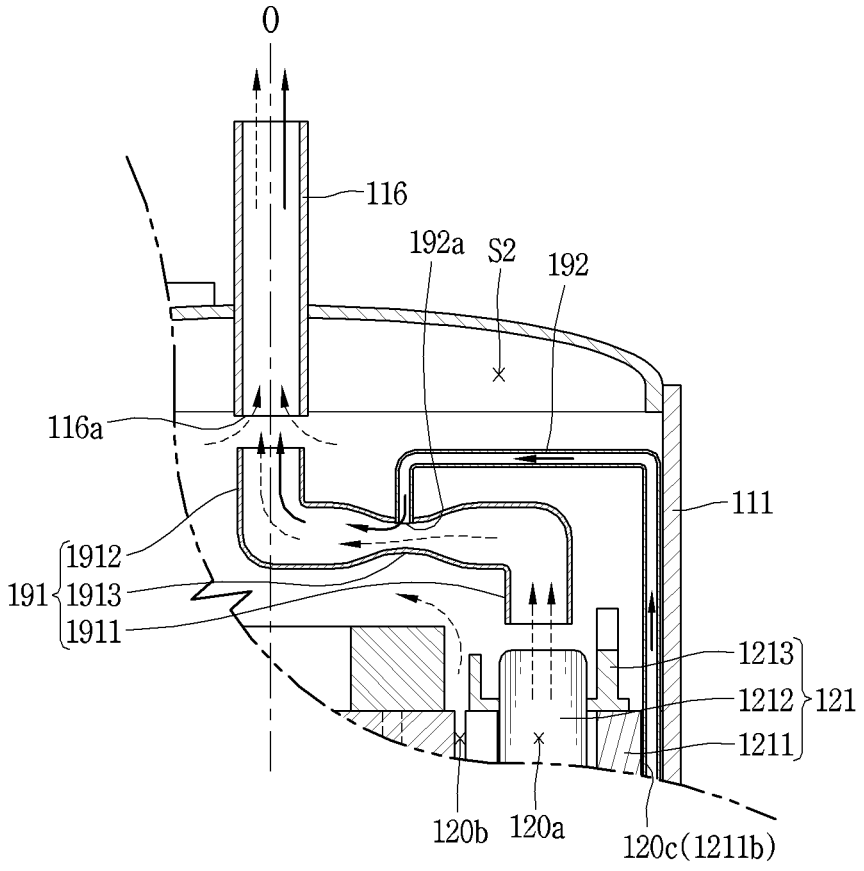
FIG. 5 is a longitudinal sectional view illustrating another implementation of a venturi tube in FIG. 2.

FIG. 5 is a longitudinal sectional view illustrating another implementation of the venturi tube in FIG. 2.

Referring to FIG. 5, the venturi tube 191 according to this implementation may be configured such that the first large-diameter portion 1911 and the second large-diameter portion 1912 are parallel or intersect with each other. For example, the center line of the first large-diameter portion 1911 and the center line of the second large-diameter portion 1912 may not be coaxially disposed but may be disposed in parallel or to intersect with each other.

In this case, the first large-diameter portion 1911 and the second large-diameter portion 1912 may be bent in opposite directions and the small-diameter portion 1913 may be linearly formed. Alternatively, in some examples, the first large-diameter portion 1911 and the second large-diameter portion 1912 may be symmetrical with each other, and the small-diameter portion 1913 may be bent a plurality of times. Otherwise, any structure in which the first large-diameter portion 1911 and the second large-diameter portion 1912 are parallel to each other may be applied.

The first large-diameter portion 1911, as illustrated in the previous implementation, may be disposed to axially face the slot 1211*d*, which is located at a portion at which the flow rate of refrigerant is the fastest, namely, coaxially with or adjacent to the discharge through hole 1812. The basic configuration of the first large-diameter portion 1911 and the small-diameter portion 1913 and the operating effects thereof are the same as those of the previous implementation of FIG. 3, and thus a description thereof will be omitted.

However, the second large-diameter portion 1912 may be disposed such that at least part of an upper end thereof overlaps the refrigerant discharge tube 116 in the axial direction. In other words, the second large-diameter portion 1912 may be located eccentrically with respect to the first large-diameter portion 1911, but the upper end of the second large-diameter portion 1912 may be disposed to face the inner end of the refrigerant discharge tube 116 in the axial direction.

As described above, the lower end of the first large-diameter portion 1911 defining the inlet of the venturi tube 191 may be disposed at a position where the flow rate of refrigerant moving to the upper space S2 is the fastest. For example, the upper end of the second large-diameter portion 1912 defining the outlet of the venturi tube 191 may be disposed to face the refrigerant discharge tube 116.

In this case, most of the liquid refrigerant suctioned into the venturi tube 191 through the liquid refrigerant discharge tube 192 may be guided directly to the refrigerant discharge tube 116 without passing through the upper space S2. Accordingly, the liquid refrigerant stagnated in the inner space 110*a* of the casing 110 can be discharged more quickly and effectively, compared to the previous implementation.

Hereinafter, a description will be given of still another implementation of the liquid refrigerant discharge unit.

That is, in the previous implementation, the refrigerant discharge tube is disposed coaxially with the rotating shaft. However, in some cases, the refrigerant discharge tube may be disposed eccentrically with respect to the axial center of the rotating shaft.

Figure 6:
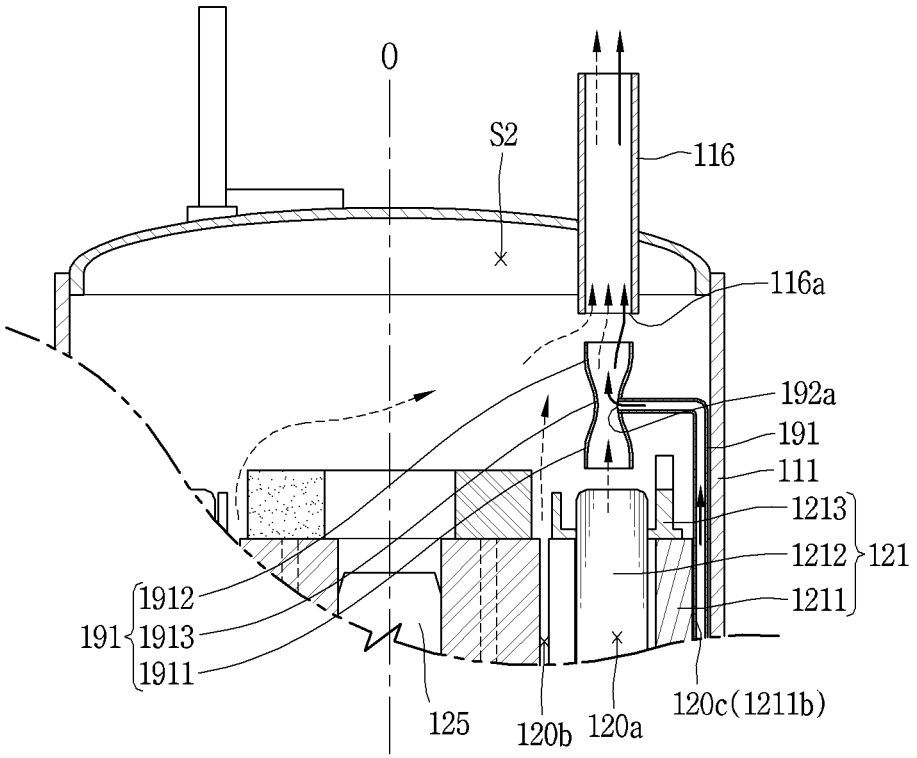
FIG. 6 is a longitudinal sectional view illustrating another implementation of a refrigerant discharge tube in FIG. 2.

FIG. 6 is a longitudinal sectional view illustrating another implementation of the refrigerant discharge tube in FIG. 2.

As illustrated in FIG. 6, the venturi tube 191 according to this implementation may be formed in a linear shape. For example, the first large-diameter portion 1911 and the second large-diameter portion 1912 may be coaxially disposed with each other. Since this is the same as the implementation of FIG. 3, a detailed description thereof will be omitted.

However, in this implementation, the refrigerant discharge tube 116 may be disposed at an eccentric position with respect to the axial center O of the rotating shaft 125. For example, the refrigerant discharge tube 116 may be located coaxially with the venturi tube 191.

Specifically, the inner end 116*a* of the refrigerant discharge tube 116 may be disposed to overlap the inner passage 120*a* (or discharge through hole) in the axial direction above the stator coil 1212.

As described above, when the inner end 116*a* of the refrigerant discharge tube 116 overlaps the inner passage 120*a* (or discharge through hole) together with the venturi tube 191 in the axial direction, the liquid refrigerant passing through the venturi tube 191 may be guided directly toward the refrigerant discharge tube 116 without passing through the upper space S2. Accordingly, the liquid refrigerant stagnated in the inner space 110*a* of the casing 110 through the liquid refrigerant discharge tube 192 at the time of initial operation can be quickly discharged to the outside of the casing 110.

In some examples, the refrigerant discharge tube 116 may alternatively be coupled through the casing 110 in a direction intersecting with the axial center O of the rotating shaft 125. Even in this case, the refrigerant discharge tube 116 can be disposed adjacent to the outlet of the venturi tube 191, thereby increasing a discharge speed of the liquid refrigerant.

Hereinafter, a description will be given of still another implementation of the liquid refrigerant discharge unit.

That is, in the previous implementations, the separate venturi tube is disposed in the upper space of the casing. However, in some cases, the refrigerant discharge tube may be configured to serve as a kind of venturi tube.

Figure 7:
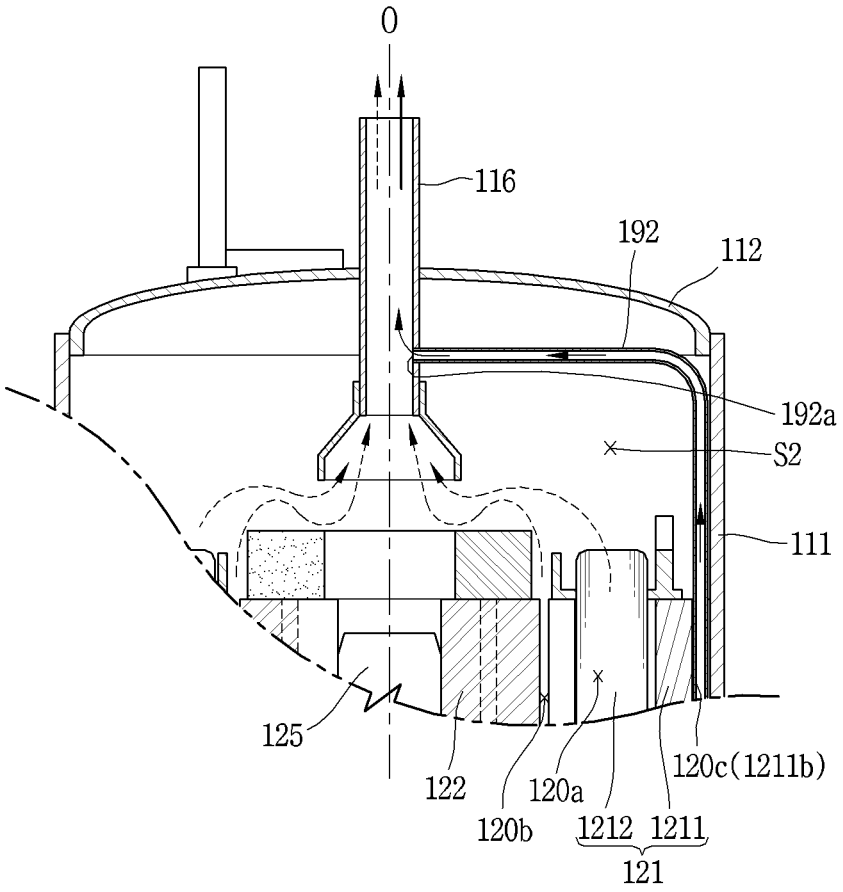
FIG. 7 is a longitudinal sectional view illustrating another implementation of the liquid refrigerant discharge unit in FIG. 2.
Figure 8:
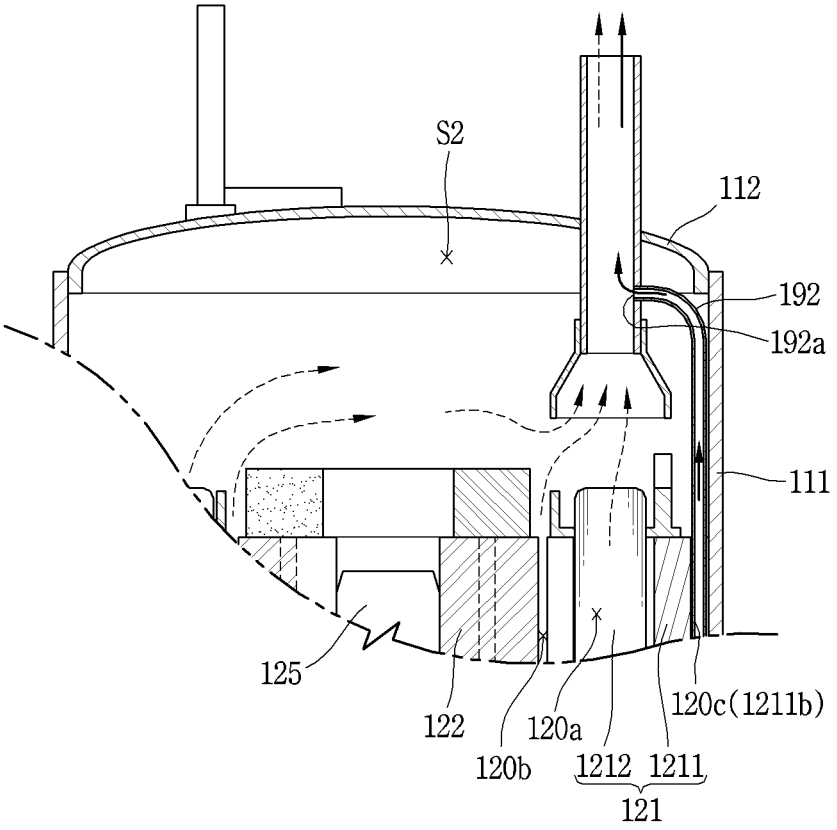
FIG. 8 is a longitudinal sectional view illustrating another implementation of the refrigerant discharge tube in FIG. 7.

FIG. 7 is a longitudinal sectional view illustrating another implementation of the liquid refrigerant discharge unit in FIG. 2 and FIG. 8 is a longitudinal sectional view illustrating another implementation of the refrigerant discharge tube in FIG. 7.

Referring to FIG. 7, the inner end of the refrigerant discharge tube 116 according to this implementation may communicate with the upper space S2 through the upper shell 112. For example, the inner end 116*a* of the refrigerant discharge tube 116 may be inserted through the upper shell 112. Here, the liquid refrigerant discharge tube 192 may be connected to a circumferential surface of the refrigerant discharge tube 116 in the upper space S2 of the casing 110.

In other words, the venturi tube 191 applied to the previous implementations may be excluded from the upper space S2 of the casing 110. Instead, the first end 192*a* of the liquid refrigerant discharge tube 192 may be connected to a periphery of the inner end 116*a* of the refrigerant discharge tube 116 in the inner space 110*a* of the casing 110.

Even in this case, the basic configuration of the refrigerant discharge tube 116 and the liquid refrigerant discharge tube 192 and the operating effects thereof are similar to those of the previous implementations, and thus a detailed description thereof will be omitted. For example, the refrigerant discharge tube 116 may have the same inner diameter along its longitudinal direction. Accordingly, the refrigerant discharge tube 116 can provide the venturi effect and also the small-diameter portion 1913 can be excluded from the refrigerant discharge tube 116, such that the refrigerant can smoothly be discharged.

However, in this implementation, as described above, the venturi tube 191 may not be separately installed in the upper space S2 of the casing 110, which can simplify the structure of the liquid refrigerant discharge unit 190 and facilitate manufacturing and installation of the liquid refrigerant discharge unit 190.

In addition, in this implementation, the venturi tube 191 can be excluded, thereby securing a degree of design freedom for the upper space S2 of the casing 110. For example, an expanded tube portion may be formed on or coupled to the inner end 116*a* of the refrigerant discharge tube 116. Accordingly, the refrigerant within the upper space S2 can be more quickly guided into the refrigerant discharge tube 116 so as to be rapidly discharged toward the condenser 20. This can improve the venturi effect in the refrigerant discharge tube 116, resulting in effectively discharging the liquid refrigerant stagnated in the inner space 110*a* of the casing 110 even without the separate venturi tube 191.

Referring to FIG. 8, the refrigerant discharge tube 116 according to this implementation may be inserted through the upper shell 112 eccentrically from the axial center O of the rotating shaft 125 so as to communicate with the upper space S2. In this case, the inner end 116*a* of the refrigerant discharge tube 116, as illustrated in the implementation of FIG. 7, may be disposed to overlap the inner passage 120*a* (or discharge through hole) in the axial direction above the stator coil 1212.

As described above, when the inner end 116*a* of the refrigerant discharge tube 116 overlaps the inner passage 120*a* (or discharge through hole) in the axial direction, the refrigerant discharge tube 116 may serve as a kind of venturi tube. Accordingly, the liquid refrigerant stagnated in the inner space 110*a* of the casing 110 at the time of initial operation through the liquid refrigerant discharge tube 192 can be quickly discharged to the outside of the casing 110. This can effectively prevent the occurrence of friction loss and wear due to lowered oil viscosity or a shortage of oil at the initial operation.

In some examples, the refrigerant discharge tube 116 may alternatively be configured as a venturi tube. In this case, the refrigerant discharge tube 116 may be formed such that the inner diameter of the small-diameter portion 1913 is as large as possible or may be diverged into plural parts, so as to prevent or minimize flow resistance of the refrigerant passing through the refrigerant discharge tube 116.

Hereinafter, a description will be given of still another implementation of the liquid refrigerant discharge unit.

That is, in the previous implementations, the liquid refrigerant discharge tube is connected to the venturi tube or the refrigerant discharge tube inside the casing. However, in some cases, the liquid refrigerant discharge tube may alternatively be connected to the refrigerant discharge tube at the outside of the casing.

Figure 9:
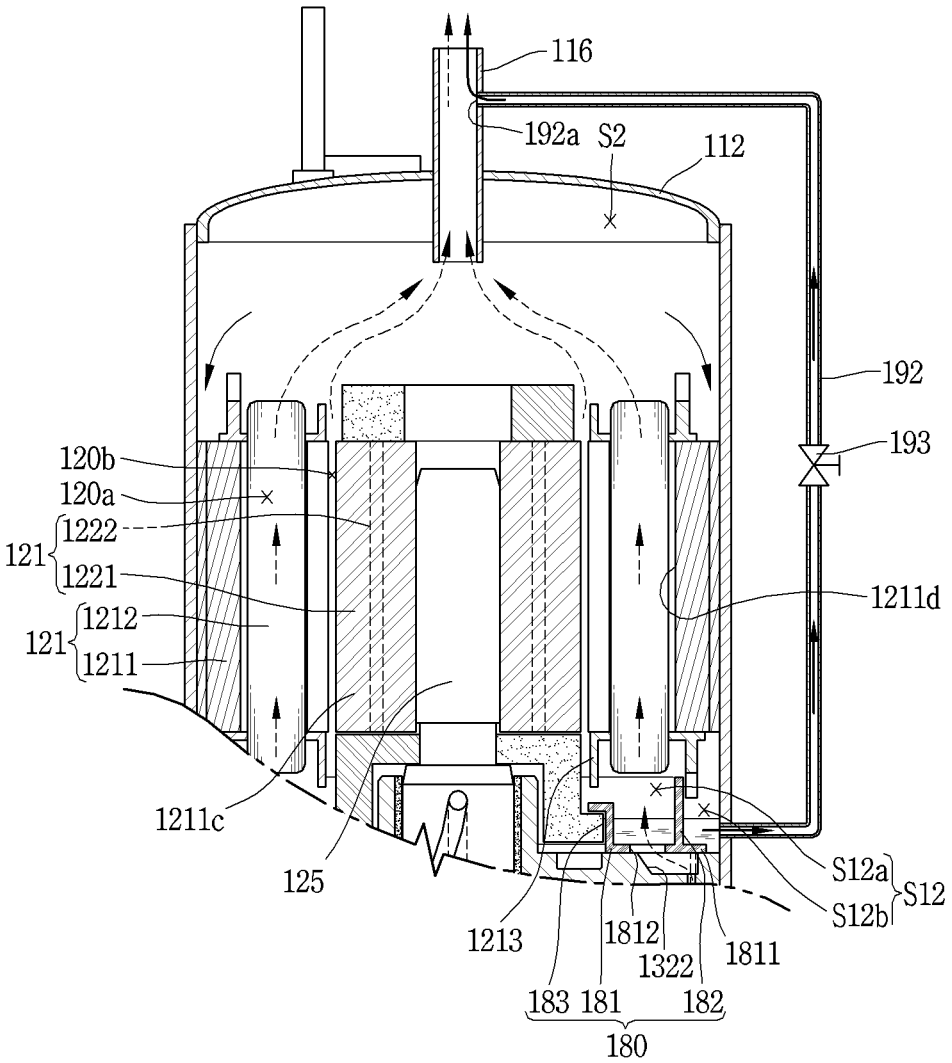
FIG. 9 is a longitudinal sectional view illustrating another implementation of the liquid refrigerant discharge unit in FIG. 7.

FIG. 9 is a longitudinal sectional view illustrating another implementation of the liquid refrigerant discharge unit in FIG. 7.

Referring to FIG. 9, the first end 192*a* of the liquid refrigerant discharge tube 192 according to this implementation may be connected to a middle portion of the refrigerant discharge tube 116 from the outside of the casing 110, and the second end 192*b* of the liquid refrigerant discharge tube 192 may communicate with the inner space 110*a* of the casing 110 through the casing 110.

The first end 192*a* of the liquid refrigerant discharge tube 192 may be connected between the compressor 10 and the condenser 20 or between the condenser 20 and the expander 30. The second end 192*b* of the liquid refrigerant discharge tube 192 may be connected to the oil return groove 1211*b* defining the outer passage 120*c*, as illustrated in the previous implementations, through the casing 110, or may communicate directly with the discharge space S12. FIG. 9 illustrates an example in which the second end 192*b* of the liquid refrigerant discharge tube 192 is directly connected to the discharge space S12.

When the second end 192*b* of the liquid refrigerant discharge tube 192 directly communicates with the discharge space S12, the entire outer passage 120*c* may be used as an oil return groove, unlike the previous implementations. This can secure a wider area of the oil return passage through which oil is returned from the upper space S2 to the oil storage space s11, thereby allowing smooth return of the oil.

Even when the refrigerant discharge tube 116 and the inner space 110*a* of the casing 110 communicate with each other through the liquid refrigerant discharge tube 192 disposed at the outside of the casing 110, the basic configuration and the operating effect thereof are similar to those of the previous implementations, and thus a detailed description thereof will be omitted.

However, in this implementation, a control valve 193 may be disposed in the middle portion of the liquid refrigerant discharge tube 192. The control valve 193 may be configured as a solenoid valve capable of selectively opening and closing the liquid refrigerant discharge tube 192.

With this configuration, while the compressor 10 or an air conditioner including the compressor 10 is operating normally, refrigerant discharged through the refrigerant discharge tube 116 can be prevented from flowing back into the casing 110 through the liquid refrigerant discharge tube 192 or the refrigerant mixed with oil can be prevented from being discharged from the inner space 110*a* of the casing 110 through the liquid refrigerant discharge tube 192.

The previous implementations illustrate the example employing the single liquid refrigerant discharge unit 190, but the liquid refrigerant discharge unit 190 may be provided in plurality. Even in this case, the configuration of the liquid refrigerant discharging unit 190 and its basic effects may be the same as or similar to those of the previous implementations.

The foregoing description has been given of the preferred implementations, but it will be understood by those skilled in the art that various modifications and changes can be made without departing from the scope of the present disclosure described in the appended claims.

What is claimed is:

1. A scroll compressor, comprising:

a casing that defines an inner space therein;

a rotating shaft disposed in the inner space of the casing;

a motor disposed in the inner space of the casing and configured to rotate the rotating shaft;

a compression unit that is disposed in the inner space of the casing at one side of the motor and configured to compress refrigerant based on rotation of the rotating shaft, the compression unit having a discharge passage configured to discharge the refrigerant compressed by the compression unit to the inner space of the casing;

a refrigerant discharge tube that has a first end connected to the inner space of the casing and a second end connected to a refrigeration cycle system, the refrigerant discharge tube being configured to discharge the refrigerant from the inner space of the casing to the refrigeration cycle system;

a venturi tube disposed in the inner space of the casing adjacent to the refrigerant discharge tube, the venturi tube having a plurality of diameters; and a liquid refrigerant discharge tube that has a first end connected to the venturi tube and a second end in fluid communication with the inner space of the casing, the second end of the liquid refrigerant discharge tube being disposed below the refrigerant discharge tube.

2. The scroll compressor of claim 1, wherein the motor defines an inner passage that passes through an inside of the motor along an axial direction of the motor, the inner passage being radially offset from an axis of the motor, and wherein the venturi tube includes a first diameter portion that is open toward the motor and defines a maximum diameter of the venturi tube among the plurality of diameters, at least a portion of the first diameter portion facing the inner passage along the axial direction.

3. The scroll compressor of claim 1, wherein the motor comprises:

a stator core fixed to an inner circumferential surface of the casing, the stator core comprising a plurality of teeth that are disposed on an inner circumferential surface of the stator core and spaced apart from one another in a circumferential direction to thereby define a slot between two of the plurality of teeth; and stator coils wound around the plurality of teeth of the stator core, and wherein the venturi tube is disposed at an upper side of the stator coils, and at least a portion of the venturi tube faces the slot.

4. The scroll compressor of claim 3, wherein the discharge passage is open toward the motor, and at least a part of the discharge passage overlaps with the slot along an axial direction of the motor, and wherein at least a part of the venturi tube overlaps with the discharge passage along the axial direction.

5. The scroll compressor of claim 1, wherein the venturi tube comprises:

a first diameter portion that defines a first open end facing the motor, the first open end defining a first diameter among the plurality of diameters of the venturi tube;

a second diameter portion that defines a second open end facing away from the motor, the second open end defining a second diameter among the plurality of diameters of the venturi tube; and a third diameter portion that fluidly communicates the first diameter portion and the second diameter portion with each other, the third diameter among the plurality of diameters portion defining a third diameter of the venturi tube that is less than the first diameter and the second diameter, wherein the second diameter portion is disposed at a position offset from an axial center of the refrigerant discharge tube, and wherein a first spacing height from a surface of the motor to the second open end is less than or equal to a second spacing height from the surface of the motor to an inner end of the refrigerant discharge tube.

6. The scroll compressor of claim 1, wherein the venturi tube comprises:

a first diameter portion that defines a first open end facing the motor, the first open end defining a first diameter among the plurality of diameters of the venturi tube;

a second diameter portion that defines a second open end facing away from the motor, the second open end defining a second diameter among the plurality of diameters of the venturi tube; and a third diameter portion that is disposed between the first diameter portion and the second diameter portion and connected to the liquid refrigerant discharge tube, the third diameter portion defining a third diameter among the plurality of diameters of the venturi tube that is less than the first diameter and the second diameter, and wherein the second diameter portion extends along an axis of the refrigerant discharge tube.

7. The scroll compressor of claim 6, wherein the first diameter portion and the second diameter portion are disposed along different axes from each other.

8. The scroll compressor of claim 6, wherein the first diameter portion and the second diameter portion are coaxial, and wherein the axis of the refrigerant discharge tube is offset from an axial center of the rotating shaft.

9. The scroll compressor of claim 1, wherein the inner space of the casing includes a discharge space defined between the motor and the compression unit, the discharge passage being open toward the discharge space, and wherein the second end of the liquid refrigerant discharge tube is located in the discharge space.

10. The scroll compressor of claim 9, wherein the discharge passage includes at least one passage arranged along a circumferential direction, and wherein the second end of the liquid refrigerant discharge tube is spaced apart from the at least one passage in the circumferential direction.

11. The scroll compressor of claim 9, further comprising a flow path guide that is disposed in the discharge space between the motor and the compression unit and divides the discharge space into an inner discharge space and an outer discharge space, wherein the discharge passage comprises at least one discharge through hole that passes through the flow path guide and is in fluid communication with the inner discharge space, and wherein the second end of the liquid refrigerant discharge tube is spaced apart from the discharge through hole in a circumferential direction.

12. An air conditioner comprising the scroll compressor of claim 1, a condenser, an expander, and an evaporator.

* * * * *